US006132950A

United States Patent [19]

Ishigaki et al.

[11] Patent Number: 6,132,950

[45] Date of Patent: Oct. 17, 2000

[54] THERMOGRAPHIC IMAGE-RECORDING ELEMENTS

[75] Inventors: Kunio Ishigaki; Takashi Naoi, both of Kanagawa, Japan

[73] Assignee: Fuji Photo Film Co., Ltd., Kanagawa, Japan

[21] Appl. No.: 09/148,797

[22] Filed: Sep. 4, 1998

[30] Foreign Application Priority Data

Sep. 9, 1997 [JP] Japan ..... 9-261016

[51] Int. Cl.[7] ..... G03C 1/498

[52] U.S. Cl. ..... 430/619; 430/523; 430/530; 430/531

[58] Field of Search ..... 430/619, 523, 430/531, 530

[56] References Cited

U.S. PATENT DOCUMENTS 5,312,893 5/1994 Hamano et al. ..... 528/190
5,547,821 8/1996 Melpolder et al. ..... 430/527
5,698,384 12/1997 Anderson et al. ..... 430/523

FOREIGN PATENT DOCUMENTS 5-297545 11/1993 Japan .
2063500 6/1981 United Kingdom .
WO9704355A1 2/1997 WIPO .

OTHER PUBLICATIONS

Condensed Chemical Dictionary, Tenth Edition, pp. 601–602, 1981.

*Primary Examiner*—Thorl Chea
*Attorney, Agent, or Firm*—Birch, Stewart, Kolasch & Birch, LLP

[57] ABSTRACT

In a thermographic image-recording element comprising an image-forming layer and a protective layer on one side of a support, and optionally a back layer on the opposite side of the support, a polymer latex is used as a binder in each of the image-forming layer, the protective layer, and the back layer. The element experiences a minimized dimensional change before and after heat development. No wrinkling occurs upon heat development.

19 Claims, 1 Drawing Sheet

THERMOGRAPHIC IMAGE-RECORDING ELEMENTS

This invention relates to thermographic image-recording elements, especially for use as photographic printing plates and for use with scanners and image setters. More particularly, it relates to thermographic image-recording elements for use as color photographic printing plates having improved dimensional stability enough to avoid film wrinkling upon heat development.

BACKGROUND OF THE INVENTION

One well-known method for the exposure of photographic photosensitive elements is an image forming method of the scanner system comprising the steps of scanning an original to produce image signals, subjecting a photographic silver halide photosensitive element to exposure in accordance with the image signals, and forming a negative or positive image corresponding to the image of the original.

There is a desire to have a procedure of providing outputs of a scanner to a film and directly printing on a printing plate without a transfer step as well as for a scanner photosensitive element having ultrahigh contrast with respect to a scanner light source having a soft beam profile.

There are known a number of photosensitive elements having a photosensitive layer on a support wherein images are formed by imagewise exposure. Among these, a technique of forming images through heat development is known as a system capable of simplifying image forming means and contributing to environmental protection.

From the contemporary standpoints of environmental protection and space saving, it is strongly desired in the photomechanical process field to reduce the quantity of spent solution. Needed in this regard is a technology relating to photothermographic elements for use in reprophotography which can be effectively exposed by means of laser scanners or laser image setters and produce distinct black images having high resolution and sharpness. These photothermographic elements offer to the customer a simple thermographic system which eliminates a need for environmentally detrimental solution type chemical agents.

The technology of forming images through heat development is disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969. These photothermographic elements generally contain a reducible non-photosensitive silver source (e.g., organic silver salt), a catalytic amount of a photocatalyst (e.g., silver halide), and a reducing agent for silver, typically dispersed in an organic binder matrix. Photothermographic elements are stable at room temperature.

When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the reducible silver salt in exposed regions provides black images in contrast to unexposed regions, forming an image.

Photothermographic elements of this type are well known in the art. In most of these elements, photosensitive layers are formed by applying coating solutions based on organic solvents such as toluene, methyl ethyl ketone (MEK) and methanol, followed by drying. The use of organic solvents is not only harmful to workers in the manufacturing procedure, but disadvantageous because of the cost for recovery and disposal of the solvents.

It is contemplated to form photosensitive layers using coating solutions based on water solvent which eliminates such concern. Such photosensitive layers are sometimes referred to as "aqueous photosensitive layers," hereinafter. For example, JP-A 52626/1974 and 116144/1978 disclose the use of gelatin as the binder. JP-A 151138/1975 discloses polyvinyl alcohol as the binder. Further, JP-A 61747/1985 discloses a combined use of gelatin and polyvinyl alcohol. Besides, JP-A 28737/1983 discloses a photosensitive layer containing water-soluble polyvinyl acetal as the binder.

It is true that the use of these binders has great environmental and economical advantages in that photosensitive layers can be formed using coating solutions based on water solvent.

However, the use of such polymers as gelatin, polyvinyl alcohol and water-soluble polyacetal as the binder has the following drawback. Dehydration shrinkage and thermal expansion of the binder simultaneously occur upon heat development, which behavior is different from the thermal expansion behavior of the support, causing films to be wrinkled. The wrinkled films are inadequate for color printing where the films are used in register with each other.

There is a desire to have a photothermographic element which is an aqueous photosensitive element advantageous from the environment and economical aspects and has good coating quality and improved dimensional stability enough to avoid wrinkling upon development.

SUMMARY OF THE INVENTION

An object of the invention is to provide a thermographic image-recording element suitable for reprophotography, especially for use with scanners and image setters and free from wrinkling upon heat development.

Another object of the invention is to provide a thermographic image-recording element which experiences minimal dimensional changes before and after heat development.

A further object of the invention is to provide a thermographic image-recording element capable of forming images of photographic quality.

A still further object of the invention is to provide a thermographic image-recording element having satisfactory film strength and free of adhesion failure.

According to the invention, there is provided a thermographic image-recording element comprising a support, an image-forming layer thereon containing at least (a) an organic silver salt, (b) a reducing agent, and (c) a photosensitive silver halide, and at least one protective layer on the image-forming layer. A polymer latex is used as a binder in each of the image-forming layer and the protective layer.

In one preferred embodiment, the thermographic image-recording element further comprises at least one back layer on an opposite side of the support to the image-forming layer, wherein a polymer latex is used as a binder in the back layer.

The polymer latex used as the binder in the protective layer is preferably an acrylic latex, styrene latex, acryl/styrene latex, vinyl chloride latex or vinylidene chloride latex. The binder in the protective layer preferably has a glass transition temperature of 25° C. to 100° C.

A styrene-butadiene latex is preferably used as the binder in the image-forming layer. The binder in the image-forming layer preferably has a glass transition temperature of −30° C. to 40° C. and a gel fraction of 30% to 90% by weight.

Preferably, the protective layer located farthest from the support contains microparticulates having a mean particle size of 1 μm to 10 μm. Also preferably, the back layer which is not an outermost layer contains microparticulates having a mean particle size of 1 μm to 10 μm.

In a further preferred embodiment, the thermographic image-recording element further comprises undercoat layers on the image-forming layer-bearing side and the opposite side of the support and a back layer located on the opposite side adjacent to the support. At least one of the undercoat layers and the back layer contains a metal oxide.

Preferably, the protective layer at its surface has a Bekk smoothness of up to 2,000 seconds, and the back layer at its surface has a Bekk smoothness of up to 2,000 seconds.

Typically, the support is a biaxially oriented polyester. Preferably, the support has been treated so as to improve the adhesion thereof to the image-forming layer and/or the back layer and then heat treated at a temperature of 130° C. to 210° C. The heat-treated support has a heat shrinkage factor of −0.03% to 0.01% in a machine direction (MD) and 0% to 0.04% in a transverse direction (TD) when heated at 120° C. for 30 seconds.

BRIEF DESCRIPTION OF THE DRAWING

The only figure.

DETAILED DESCRIPTION OF THE INVENTION

Figure 1:
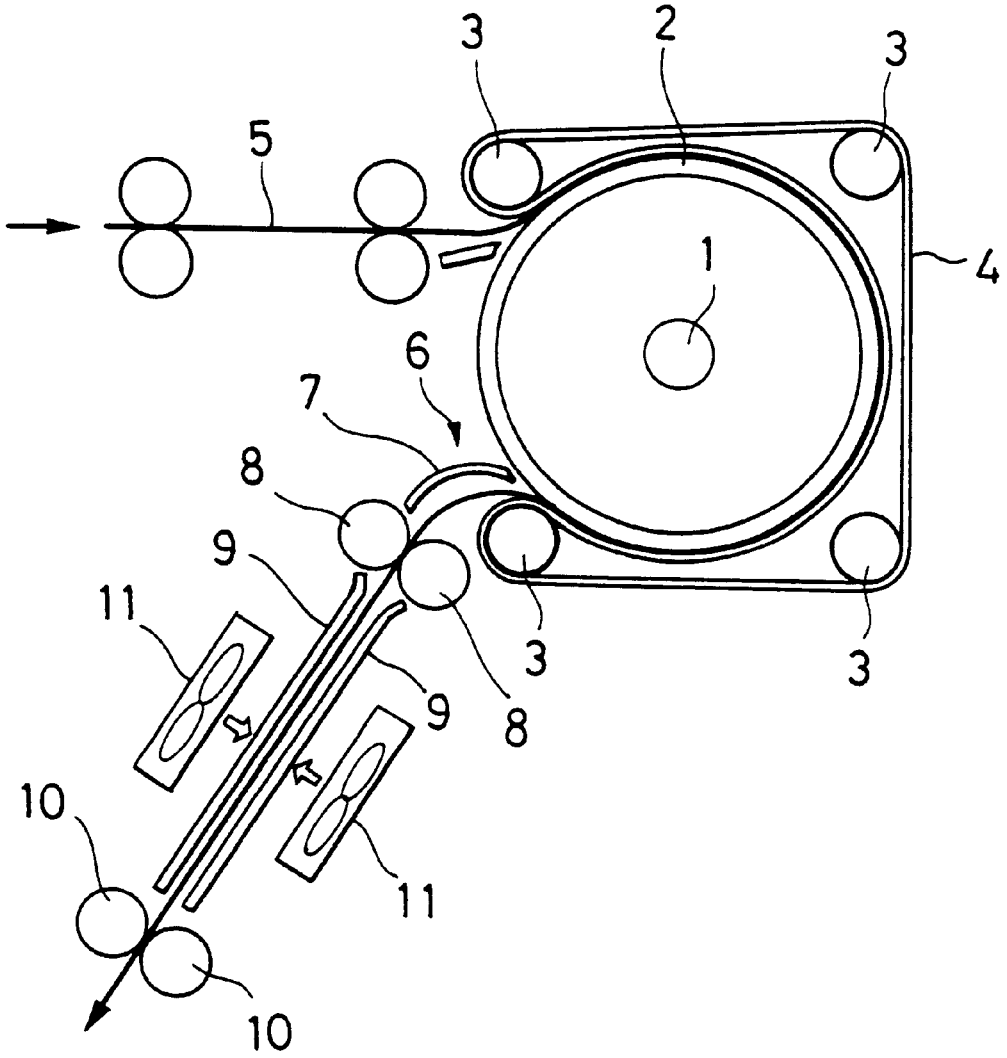
FIG. 1 is a schematic view of one exemplary heat developing apparatus for use in the processing of the thermographic element according to the invention.

The thermographic image-recording element of the invention has an image-forming layer containing an organic silver salt, a reducing agent and a photosensitive silver halide on a support, and at least one protective layer on the image-forming layer. The thermographic image-recording element according to the preferred embodiment of the invention has at least one back layer on the back side of the support opposite to the image-forming layer. According to the invention, a polymer latex is used as a binder in each of the image-forming layer, the protective layer and optionally, the back layer. The use of a polymer later in each of these layers enables aqueous coating using a solvent or dispersing medium based on water, which is advantageous from the environment and cost standpoints, and results in a thermographic image-forming element free of wrinkling upon heat development. In the preferred embodiment wherein a specific heat-treated support is used, there is obtained a thermographic image-forming element which experiences minimal dimensional changes before and after heat development.

The "polymer latex" is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

Polymers of polymer latexes used as the binder according to the invention have glass transition temperatures (Tg) whose preferred range differs among the protective layer, the back layer and the image-forming layer. For the protective layer and the back layer which are to come in contact with various equipment, polymers having a Tg of 25° C. to 100° C. are especially preferred from the standpoints of film strength and adhesion failure prevention. For the image-forming layer, polymers having a Tg of −30° C. to 40° C., especially 0° C. to 40° C. are preferred in order to promote the diffusion of photographically effective addenda upon heat development, thereby achieving satisfactory photographic properties such as high Dmax and low fog. With respect to the polymer latex used in the image-forming layer, the polymer should preferably have a gel fraction of 30% to 90% by weight for the same reason. The gel fraction is determined by applying a polymer latex, drying at a temperature of 70° C. to form a film sample, immersing the film sample in tetrahydrofuran (THF) at 25° C. for 24 hours, quantitatively determining the content of insolubles, and calculating according to the following equation.

$$\text{Gel fraction (\%)} = (\text{the weight (g) of insolubles})/(\text{the weight (g) of polymer latex film}) \times 100$$

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear, branched or crosslinked. The polymer may be either a homopolymer or a copolymer having two or more monomers polymerized together. The copolymer may be either a random copolymer or a block copolymer. The polymer preferably has a weight average molecule weight Mw of about 5,000 to about 1,000,000, more preferably about 10,000 to about 100,000. Polymers with a too lower molecular weight would generally provide a low mechanical strength as the binder whereas polymers with a too higher molecular weight are difficult to form films.

Illustrative examples of the polymer latex which can be used as the binder in the thermographic image-recording element of the invention include latexes of methyl methacrylate/ethyl methacrylate/methacrylic acid copolymers, latexes of methyl methacrylate/2-ethylhexyl acrylate/hydroxyethyl methacrylate/styrene/acrylic acid copolymers, latexes of styrene/butadiene/acrylic acid copolymers, latexes of styrene/butadiene/divinyl benzene/methacrylic acid copolymers, latexes of methyl methacrylate/vinyl chloride/acrylic acid copolymers, and latexes of vinylidene chloride/ethyl acrylate/acrylonitrile/methacrylic acid copolymers. These polymers or polymer latexes are commercially available. Exemplary acrylic resins are Sebian A-4635, 46583 and 4601 (Daicell Chemical Industry K.K.), Nipol LX811, 814, 820, 821, 857 and 857x2 (Nippon Zeon K.K.), VONCORT R3340, R3360, R3370, 4280, 2830 and 2210 (Dai-Nippon Ink & Chemicals K.K.), Jurimer ET-410, 530, SEK101-SEK301, FC30 and FC35 (Nippon Junyaku K.K.), and Polyzol F410, AM200 and AP50 (Showa Kobunshi K.K.). Exemplary polyester resins are FINETEX ES650, 611, 675, and 850 (Dai-Nippon Ink & Chemicals K.K.) and WD-size and WMS (Eastman Chemical Products, Inc.). Exemplary polyurethane resins are HYDRAN AP10, 20, 30 and 40 and VONDIC 1320NS (Dai-Nippon Ink & Chemicals K.K.). Exemplary rubbery resins are LACSTAR 7310K, 3307B, 4700H, 7132C and LQ-618-1 (Dai-Nippon Ink & Chemicals K.K.) and Nipol Lx416, 410, 430, 435 and 2507 (Nippon Zeon K.K.). Exemplary vinyl chloride resins are Nipol G351 and G576 (Nippon Zeon K.K.). Exemplary vinylidene chloride resins are L502 and L513 (Asahi Chemicals K.K.) and Aron D7020, D5040 and D5071 (Toa Synthesis K.K.). Exemplary olefin resins are Chemipearl S120 and SA100 (Mitsui Petro-Chemical K.K.). These polymers may be used alone or in admixture of two or more.

Of these polymer latexes, acrylic, styrene, acrylic/styrene, vinyl chloride, and vinylidene chloride polymer latexes are preferable as the binder in the protective layer. Illustrative preferred examples are VONCORT R3370, 4280, and Nipol Lx857 acrylic resins, methyl methacrylate/2-ethylhexyl acrylate/hydroxyethyl methacrylate/styrene/acrylic acid copolymers, Nipol G576 vinyl chloride resin, and Aron D5071 vinylidene chloride resin.

As the binder in the image-forming layer, latexes of styrene/butadiene polymers are preferable. Illustrative preferred examples are LACSTAR 3307B, Nipol Lx430 and 435 rubbery resins.

As the binder in the back layer, latexes of acrylic, olefinic and vinylidene chloride polymers are preferable. Illustrative preferred examples are Jurimer ET-410, Sebian A-4635 and Polyzol F410 acrylic resins, Chemipearl S120 olefin resin, L502 and Aron D7020 vinylidene chloride resins.

A hydrophilic polymer may be added to the binder in an amount of up to 20% by weight of the entire binder. Such hydrophilic polymers are polyvinyl alcohol, methyl cellulose, hydroxypropyl cellulose, carboxymethyl cellulose, and hydroxypropyl methyl cellulose. The amount of the hydrophilic polymer added is preferably less than 10% by weight of the entire binder in each of the protective layer and the image-forming layer.

In the practice of the invention, the photographic component layers are preferably formed by applying aqueous coating solutions followed by drying. By the term "aqueous", it is meant that water accounts for at least 60% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

In the protective layer according to the invention, the total amount of binder is preferably 0.2 to 5.0 g/m$^2$, more preferably 0.5 to 3.0 g/m$^2$.

In the image forming layer according to the invention, the total amount of binder is preferably 0.2 to 30 g/m$^2$ more preferably 1.0 to 15 g/m$^2$.

In the back layer according to the invention, the total amount of binder is preferably 0.01 to 3 g/m$^2$, more preferably 0.05 to 1.5 g/m$^2$.

To the respective layers, crosslinking agents for crosslinking, surfactants for ease of application, and other addenda may be added.

Sometimes each of these layers consists of two or more sub-layers. Where two or more image-forming layers are included, it is preferred to use a polymer latex as the binder in all the image-forming layers. The protective layer is a layer on the image-forming layer, and two or more protective layers are sometimes included. In this case, a polymer latex is preferably used in at least one protective layer, especially in the outermost protective layer. The back layer is a layer on a subbing layer on the back surface of the support, and two or more back layers are sometimes included. In this case, a polymer latex is preferably used in at least one back layer, especially in the outermost back layer.

In the thermographic image-recording element of the invention, a variety of supports may be used. Typical supports include polyesters such as polyethylene terephthalate and polyethylene naphthalate, cellulose nitrate, cellulose esters, polyvinyl acetal and polycarbonate. Among others, biaxially oriented polyesters, especially biaxially oriented polyethylene terephthalate (PET) is preferred as the support from the standpoints of strength, dimensional stability and chemical resistance. The support preferably has a thickness of 90 to 180 $\mu$m as expressed by the thickness of its base with the subbing layer excluded.

Preferred as the support used in the thermographic image-recording element of the invention are films of polyesters, especially polyethylene terephthalate, which have been biaxially stretched and then heat treated at a temperature in the range of 130 to 210° C. for mitigating the internal distortion left after stretching and for preventing distortion from being generated by thermal shrinkage during subsequent heat development. Such thermal relaxation treatment may be carried out at a fixed temperature within this range or while raising the temperature within this range.

Heat treatment may be done on the support in roll form or while feeding the support in web form. In the case of carrying out heat treatment on the support while feeding it in web form, the support is preferably fed under a tension of up to 7 kg/cm$^2$, especially up to 4.2 kg/cm$^2$. The lower limit of feed tension is not critical although it is usually about 0.5 kg/cm$^2$.

Heat treatment of this type is preferably carried out after the support is subjected to treatment for improving the adhesion to the image-forming layer or back layer, for example, after the support is provided with a subbing layer.

Preferably, the heat-treated support has a heat shrinkage factor of −0.03% to 0.01% in a moving direction (MD) and 0% to 0.04% in a transverse direction (TD) when heated at 120° C. for 30 seconds.

If necessary, a subbing layer is formed on the support. The subbing layer is based on a binder such as SBR, vinylidene chloride, polyester or gelatin. The subbing layer may be of multilayer construction and be formed on one or both surfaces of the support. At least one of subbing layers can be a conductive layer. Often, the subbing layer has a thickness of 0.01 to 5 $\mu$m, preferably 0.05 to 1 $\mu$m. When the subbing layer is a conductive layer, it is preferably 0.01 to 1 $\mu$m thick, more preferably 0.03 to 0.8 $\mu$m thick.

In the thermographic image-recording element of the invention, it is preferred that the back layer or subbing layer disposed adjacent to the support contain a metal oxide for restraining dust deposition and that at least one of the back layer and the subbing layers (on both sides of the support) be a conductive layer. It is preferred to avoid the situation that the conductive layer is the outermost back layer.

The metal oxide used herein is preferably selected from, those described in JP-A 20033/1986 and 82504/1981. The amount of the conductive metal oxide used is preferably 0.05 to 20 g/m$^2$, more preferably 0.1 to 10 g/m$^2$ of the image-recording element. The metal oxide-containing layer preferably has a surface resistivity of up to $10^{12}$ Ω. especially up to $10^{11}$ Ω in an atmosphere of 25° C. and RH 25% because good antistatic properties are then exerted. The lower limit of surface resistivity is not critical although it is usually about $10^7$ Ω.

In the practice of the invention, better antistatic properties are exerted by using a fluorinated surfactant in combination with the metal oxide.

Preferred examples of the fluorinated surfactant used herein include surfactants having fluoroalkyl, fluoroalkenyl or fluoroaryl groups of 4 or more carbon atoms (usually up to 15 carbon atom) and ionic groups, for example, anionic groups (e.g., sulfonic acid or salts, sulfuric acid or salts, carboxylic acid or salts and phosphoric acid or salts), cationic groups (e.g., amine salts, ammonium salts, aromatic amine salts, sulfonium salts, and phosphonium salts), betain groups (e.g., carboxylamine salts, carboxyammonium salts, sulfoamine salts, sulfoammonium salts, and phosphoammonium salts), or nonionic groups (e.g. substituted or unsubstituted polyoxyalkylene groups, polyglyceryl groups and sorbitan residues).

These fluorinated surfactants are disclosed in JP-A 10722/1974, 149938/1980, 196544/1983, BP 1,330,356, 1,417,915, 1,439,402, U.S. Pat. Nos. 4,335,201 and 4,347,308.

Illustrative examples of the fluorinated surfactant are given below.

F-1

$C_8F_{17}SO_3K$

F-2

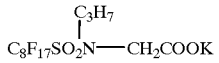

F-3

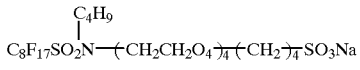

F-4

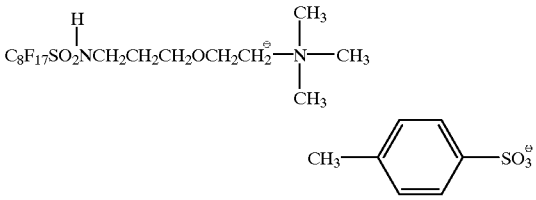

F-5

$C_8F_{17}SO_3Li$

The layer to which the fluorinated surfactant is added is not critical insofar as it belongs to the image-recording element of the invention. For example, the fluorinated surfactant may be added to any of the surface protective layer, emulsion layer, intermediate layer, subbing layer, and back layer. Of these, the preferred site of addition is the surface protective layer which may be disposed either on the image-forming layer side or on the back layer side. More preferably the fluorinated surfactant is added to at least the surface protective layer on the image-forming layer side.

Where the surface protective layer is composed of two or more layers, the fluorinated surfactant may be added to any of the layers. Alternatively, the fluorinated surfactant is overcoated on the surface protective layer.

The amount of the fluorinated surfactant used may be 0.0001 to 1 g/m$^2$, more preferably 0.0002 to 0.25 g/m$^2$, and most preferably 0.0003 to 0.1 g/m$^2$ of the image-recording element. If desired, a mixture of two or more fluorinated surfactants is used.

The respective layers have a degree of smoothness as expressed by a Bekk smoothness. The Bekk smoothness can be determined by JIS P-8119, "Smoothness test on paper sheets and boards by a Bekk tester" and TAPPI standard test T479.

At least one of the outermost layer surfaces on the image-forming layer-bearing and opposite sides of the thermographic image-recording element, desirably both, should preferably have a Bekk smoothness of up to 2,000 seconds, more preferably 10 to 2,000 seconds.

The Bekk smoothnesses of the outermost layer surface on the image-forming layer-bearing side and the outermost layer surface on the opposite side of the thermographic image-recording element can be controlled by changing the mean particle size and addition amount of fine particles contained in these layers and generally known as a matte agent. Preferably the matte agent is contained, on the image-forming layer side, in the protective layer which becomes the outermost layer disposed remotest from the support, and on the opposite side, in the back layer which is not the outermost layer.

The matte agent preferably has a mean particle size of 1 to 10 μm. An appropriate amount of the matte agent added is 5 to 400 mg/m$^2$, especially 10 to 200 mg/m$^2$.

The matte agent used herein may be any of solid particles which do not adversely affect photographic properties. Examples of inorganic matte agents include silicon dioxide, oxides of titanium and aluminum, carbonates of zinc and calcium, sulfates of barium and calcium, and silicates of calcium and aluminum. Exemplary organic matte agents are organic polymer matte agents including cellulose esters, polymethyl methacrylate, polystyrene and poly(divinyl benzene) and copolymers thereof. Preferred examples of the matte agent used herein are porous matte agents described in JP-A 109542/1991, page 2, lower-left column, line 8 to page 3, upper-right column, line 4; matte agents surface modified with alkalis described in JP-A 127142/1992, page 3, upper-right column, line 7 to page 5, lower-right column, line 4; and organic polymer matte agents described in JP-A 118542/1994, paragraphs [0005] to [0026].

A mixture of such matte agents is acceptable. Exemplary are a mixture of an inorganic matte agent and an organic matte agent, a mixture of a porous matte agent and a non-porous matte agent, a mixture of an irregular shape matte agent and a spherical matte agent, and a mixture of matte agents with different mean particle sizes (for example, a mixture of a matte agent with a mean particle size of at least 1.5 μm and another matte agent with a mean particle size of up to 1 μm as described in JP-A 118542/1994).

In the practice of the invention, a lubricant is preferably contained in the outermost layer on the image-forming layer side and/or the opposite side. The lubricant used herein may be any of compounds which, when present on an article surface, are effective for reducing the coefficient of friction of the article surface from that of the lubricant-free article surface.

Typical examples of the lubricant include silicone lubricants as described in U.S. Pat. Nos. 3,042,522, 3,080,317, 3,489,567, 4,004,927, 4,047,958, BP 955,061 and 1,143,118; higher fatty acid, alcohol and acid amide lubricants as described in U.S. Pat. Nos. 2,454,043, 2,732,305, 2,976,148, 3,206,311, German Patent Nos. 1,284,295 and 1,284,294;

metal soaps as described in BP 1,263,722 and U.S. Pat. No. 3,933,516; ester and ether lubricants as described in U.S. Pat. Nos. 2,588,765, 3,121,060 and BP 1,198,387; and taurine lubricants as described in U.S. Pat. Nos. 3,502,473 and 3,042,222.

Illustrative lubricants which are preferred are Serozoru 524 (based on carnauba wax), Polylon A, 393, H-481 (based on polyethylene wax), Himicron G-110 (based on ethylene bisstearic acid amide), and Himicron G-270 (based on stearic acid amide), all available from Chukyo Yushi K.K.

The amount of the lubricant added in a layer is usually 0.1 to 50% by weight, preferably 0.5 to 30% by weight of the binder in the same layer.

Silver halide

The photosensitive silver halide used herein may be silver chloride, silver chlorobromide or silver iodochlorobromide. The halogen composition in grains may have a uniform distribution or a non-uniform distribution wherein the halogen concentration changes in a stepped or continuous manner.

A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller mean grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of (1001 face is preferably at least 50%, more preferably at least 65%, most preferably at least 80%. Note that the proportion of Miller index {100) face can be determined by the method described in T. Tani, J. Imaging Sci., 29, 165 (1985), utilizing the adsorption dependency of {111} face and (100} face upon adsorption of a sensitizing dye.

The photosensitive silver halide grains used herein may contain any of metals or metal complexes belonging to Groups VII and VIII (or Groups 7 to 10) in the Periodic Table. Preferred metals or central metals of metal complexes belonging to Groups VII and VIII in the Periodic Table are rhodium, rhenium, ruthenium, osmium, and iridium. The metal salts may be used alone or in admixture of complexes of a common metal or different metals. The content of metal or metal complex is preferably 1 nmol to 10 mmol, more preferably 10 nmol to 100 $\mu$mol, per mol of silver. Illustrative metal complexes are those of the structures described in JP-A 225449/1995.

The rhodium compounds which can be used herein are water-soluble rhodium compounds, for example, rhodium (III) halides and rhodium complex salts having halogen, amine or oxalato ligands, such as hexachlororhodium (III) complex, salt, pentachloroaquorhodium (III) complex salt, tetrachlorodiaquorhodium (III) complex salt, hexabromorhodium (III) complex salt, hexamminerhodium (III) complex salt, and trioxalatorhodium (III) complex salt. These rhodium compounds are used by dissolving in water or suitable solvents. They are preferably added by a method commonly employed for stabilizing a solution of a rhodium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble rhodium, it is possible to add, during preparation of silver halide, separate silver halide grains previously doped with rhodium, thereby dissolving rhodium.

An appropriate amount of the rhodium compound added is $1\times10^{-8}$ to $5\times10^{-6}$ mol, especially $5\times10^{-8}$, to $1\times10^{-6}$ mol, per mol of silver halide.

The rhodium compounds may be added at an appropriate stage during preparation of silver halide emulsion grains or prior to the coating of the emulsion. Preferably, the rhodium compound is added during formation of the emulsion so that the compound is incorporated into silver halide grains.

In the practice of the invention, rhenium, ruthenium and osmium are added in the form of water-soluble complex salts as described in JP-A 2042/1988, 285941/1989, 20852/1990 and 20855/1990. Especially preferred are hexacoordinate complexes represented by the formula: $[ML_6]^{n-}$ wherein M is Ru, Re or Os, L is a ligand, and letter n is equal to 0, 1, 2, 3 or 4. The counter ion is not critical although it is usually an ammonium or alkali metal ion. Preferred ligands are halide ligands, cyanide ligands, cyanate ligands, nitrosil ligands, and thionitrosil ligands.

Illustrative, non-limiting, examples of the complex used herein are given below.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Cs(NS)Br_5]^{2-}$ | $[Os(O)_2(CN)_4]^{4-}$ | |

An appropriate amount of these compounds added is $1\times10^{-9}$ to $1\times10^{-5}$ mol, especially $1\times10^{-8}$ to $1\times10^{-6}$ mol, per mol of silver halide.

These compounds may be added at an appropriate stage during preparation of silver halide emulsion grains or prior to the coating of the emulsion. Preferably, the compound is added during formation of the emulsion so that the compound is incorporated into silver halide grains.

In order that the compound be added during formation of silver halide grains so that the compound is incorporated into silver halide grains, there can be employed a method of adding a powder metal complex or an aqueous solution of a powder metal complex dissolved together with NaCl or KCl, to a water-soluble salt or water-soluble halide solution during formation of grains; a method of preparing silver halide grains by adding an aqueous solution of a metal complex as a third solution when silver salt and halide solutions are simultaneously mixed, thereby simultaneously mixing the three solutions; or a method of admitting a necessary amount of an aqueous solution of a metal complex into a reactor during formation of grains. Of these, the method of adding a powder metal complex or an aqueous solution of a powder metal complex dissolved together with NaCl or KCl to a water-soluble halide solution is especially preferred.

For addition to surfaces of grains, a necessary amount of an aqueous solution of a metal complex can be admitted into a reactor immediately after formation of grains, during or after physical ripening or during chemical ripening.

As the iridium compound, a variety of compounds may be used. Examples include hexachloroiridium, hexammineiridnium, trioxalatoiridium, hexacyanoiridium, and pentachloronitrosiliridium. These iridium compounds are used by dissolving in water or suitable solvents. They are preferably added by a method commonly employed for stabilizing a solution of an iridium compound, that is, a method of adding an aqueous solution of a hydrogen halide (e.g., hydrochloric acid, hydrobromic acid or hydrofluoric acid) or an alkali halide (e.g., KCl, NaCl, KBr or NaBr). Instead of using the water-soluble iridium, it is possible to add, during preparation of silver halide, separate silver halide grains previously doped with iridium, thereby dissolving iridium.

The silver halide grains used herein may contain metal atoms such as cobalt, iron, nickel, chromium, palladium, platinum, gold, thallium, copper, and lead. Preferred compounds of cobalt, iron, chromium and ruthenium are hexacyano metal complexes. Illustrative, non-limiting, examples include ferricyanate, ferrocyanate, hexacyanocobaltate, hexacyanochromate and hexacyanoruthenate ions. The distribution of the metal complex in silver halide grains is not critical. That is, the metal complex may be contained in silver halide grains uniformly or at a high concentration in either the core or the shell.

An appropriate amount of the metal added is $1\times10^{-9}$ to $1\times10^{-4}$ mol per mol of silver halide. The metal may be contained in silver halide grains by adding a metal salt in the form of a single salt, double salt or complex salt during preparation of grains.

Photosensitive silver halide grains may be desalted by any of well-known water washing methods such as noodle and flocculation methods although silver halide grains may be either desalted or not according to the invention.

The silver halide emulsion used herein should preferably be chemically sensitized. The chemical sensitization methods which can be used herein are sulfur, selenium, tellurium, and noble metal sensitization methods which are well known in the art. These methods may be used singly or in combination. When they are used together, preferred combinations are a combination of sulfur sensitization with gold sensitization, a combination of sulfur sensitization with selenium sensitization and gold sensitization, a combination of sulfur sensitization with tellurium sensitization and gold sensitization, and a combination of sulfur sensitization with selenium sensitization, tellurium sensitization and gold sensitization.

Sulfur sensitization is generally carried out by adding a sulfur sensitizer to an emulsion and agitating the emulsion at an elevated temperature above 40° C. for a certain time. The sulfur sensitizers used herein are well-known sulfur compounds, for example, sulfur compounds contained in gelatin as well as various sulfur compounds such as thiosulfates, thioureas, thiazoles, and rhodamines. Preferred sulfur compounds are thiosulfate salts and thiourea compounds. The amount of the sulfur sensitizer added varies with chemical ripening conditions including pH, temperature and silver halide grain size although it is preferably $10^{-7}$ to $10^{-2}$ mol, more preferably $10^{-5}$ to $10^{-3}$ mol per mol of silver halide.

It is also useful to use selenium sensitizers which include well-known selenium compounds. Specifically, selenium sensitization is generally carried out by adding an unstable selenium compound and/or non-unstable selenium compound to an emulsion and agitating the emulsion at elevated temperature above 40° C. for a certain time. Preferred examples of the unstable selenium compound include those described in JP-B 15748/1969, JP-B 13489/1968, JP-A 25832/1992, JP-A 109240/1992 and Japanese Patent Application No. 121798/1991. Especially preferred are the compounds represented by general formulae (VIII) and (IX) in Japanese Patent Application No. 121798/1991.

The tellurium sensitizers are compounds capable of forming silver telluride, which is presumed to become sensitization nuclei, at the surface or in the interior of silver halide grains. The production rate of silver telluride in a silver halide emulsion can be determined by the test method described in Japanese Patent Application No. 146739/1992. Exemplary tellurium sensitizers include diacyltellurides, bis(oxycarbonyl)tellurides, bis-(carbamoyl)tellurides, bis(oxycarbonyl)ditellurides, bis(carbamoyl)ditellurides, compounds having a P═Te bond, tellurocarboxylic salts, Te-organyltellurocarboxylic esters, di(poly)tellurides, tellurides, telluroles, telluroacetals, tellurosulfonates, compounds having a P—Te bond, Te-containing heterocycles, tellurocarbonyl compounds, inorganic tellurium compounds, and colloidal tellurium. Examples are described in U.S. Pat. Nos. 1,623,499, 3,320,069, 3,772,031, BP 235,211, 1,121,496, 1,295,462, 1,396,696, Canadian Patent No. 800,958, Japanese Patent Application Nos. 333819/1990, 53693/1991, 131598/1991, 129787/1992, J. Chem. Soc. Chem. Commun., 635 (1980), ibid., 1102 (1979), ibid., 645 (1979), J. Chem. Soc. Perkin. Trans., 1, 2191 (1980), S. Patai Ed., The Chemistry of Organic Selenium and Tellurium Compounds, Vol. 1 (1986), ibid., Vol. 2 (1987). Especially preferred are the compounds represented by general formulae (II), (III) and (IV) in Japanese Patent Application No. 146739/1992.

The amounts of the selenium and tellurium sensitizers used vary with the type of silver halide grains, chemical ripening conditions and other factors although they are preferably about $10^{-8}$ to $10^{-2}$ mol, more preferably about $10^{-7}$ to $10^{-3}$ mol per mol of silver halide. The chemical sensitizing conditions are not particularly limited although preferred conditions include a pH of 5 to 8, a pAg of 6 to 11, more preferably 7 to 10, and a temperature of 40 to 95° C., more preferably 45 to 85° C.

Useful as the noble metal sensitizers are compounds of gold, platinum, palladium, and iridium, with gold sensitization being especially preferred. Examples of the gold sensitizer include chloroauric acid, potassium chloroaurate, potassium aurithiocyanate, and gold sulfide. An appropriate amount of the gold sensitizer is about $10^{-7}$ to $10^{-2}$ mol per mol of silver halide.

In the preparation of the silver halide emulsion used herein, any of cadmium salts, sulfite salts, lead salts, and thallium salts may be co-present in the silver halide grain forming step or physical ripening step.

Reduction sensitization may also be used in the practice of the invention. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

To the silver halide emulsion according to the invention, thiosulfonic acid compounds may be added by the method described in EP-A 293,917.

The silver halide emulsion in the thermographic image-forming element according to the invention may be a single emulsion or a mixture of two or more emulsions which are different in mean grain size, halogen composition, crystal habit or chemical sensitizing conditions.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of the inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Organic silver salt

The organic silver salt which can be used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of the image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. No. 4,761,361 and 4,775,613.

The organic silver salt which can be used herein may take any desired shape although needle crystals having a minor axis and a major axis are preferred. In the practice of the invention, grains should preferably have a minor axis of 0.01 $\mu$m to 0.20 $\mu$m and a major axis of 0.10 $\mu$m to 5.0 $\mu$m, more preferably a minor axis of 0.01 $\mu$m to 0.15 $\mu$m and a major axis of 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, roller mills, and high-pressure homogenizers.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyl methyl cellulose, as well as naturally occurring high molecular weight compounds such as gelatin.

In general, the dispersant is mixed with the organ c silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g/m$^2$, more preferably about 1 to 3 g/m$^2$, as expressed by a silver coverage per square meter of the thermographic image-recording element.

Reducing agent

The thermographic image-recording element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For photothermographic elements using organic silver salts, a wide range of reducing agents are disclosed, for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6'-dibromo-2,2,-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For photothermographic elements using organic silver salts, a wide range of toners are disclosed, for example, JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pats. No. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobaltic hexammine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl) aryldicarboxyimides such as (N,N-dimethylaminomethyl) phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)-bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)-phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, et mills, and roller mills. Dispersing aids may be used in preparing the solid particle dispersion.

Contrast enhancer

In the practice of the invention, contrast enhancers may be used for forming ultrahigh contrast images. Included are hydrazine derivatives as described in U.S. Pat. Nos. 5,464,738, 5,496,695, 5,512,411, 5,536,622, Japanese Patent Application Nos. 228627/1995, 215822/1996, 130842/1996, 148113/1996, 156378/1996, 148111/1996, and 148116/1996; compounds having a quaternary nitrogen atom as described in Japanese Patent Application No. 83566/1996, and acrylonitrile compounds as described in U.S. Pat. No. 5,545,515. Illustrative examples are compounds 1 to 10 in U.S. Pat. No. 5,464,738, compounds H-1 to H-28 in U.S. Pat. No. 5,496,695, compounds I-1 to I-86 in Japanese Patent Application No. 215822/1996, compounds H-1 to H-62 in 130842/1996, compounds I-1 to I-21 in 148113/1996, compounds 1 to 50 in 148111/1996, compounds 1 to 40 in 148116//1996, and compounds P-1 to P-26 and T-1 to T-18 in 83566/1996, and compounds CN-1 to CN-13 in U.S. Pat. No. 5,545,515.

Any of the aforementioned ultrahigh contrast enhancers may be used as the contrast enhancer according to the invention insofar as they have the function for achieving the objects of the invention. Preferably, hydrazine derivatives are used.

Any of hydrazine derivatives may be used as the contrast enhancer according to the invention insofar as they have the function for achieving the objects of the invention. Preferred hydrazine derivatives are of the following general formula (H).

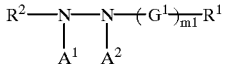

(H)

In formula (H), $R^2$ is an aliphatic, aromatic or heterocyclic group. $R^1$ is hydrogen or a block group. $G^1$ is —CO—, —COCO—, —C(=S)—, —SOS—, —SO—, —PO($R^2$)— or iminomethylene group. $R^3$ is selected from the same range as defined for $R^1$ and may be different from $R^1$. Both $A^1$ and $A^2$ are hydrogen, or one of $A^1$ and $A^2$ is hydrogen and the other is a substituted or unsubstituted alkylsulfonyl, substituted or unsubstituted arylsulfonyl or substituted or unsubstituted acyl group. Letter ml is equal to 0 or 1. $R^1$ is an aliphatic, aromatic or heterocyclic group when $m_1$ is 0.

In formula (H), the aliphatic groups represented by $R^3$ are preferably substituted or unsubstituted, normal, branched or cyclic alkyl, alkenyl and alkynyl groups having 1 to 30 carbon atoms.

In formula (H), the aromatic groups represented by R' are preferably monocyclic or fused ring aryl groups, for example, phenyl and naphthyl groups derived from benzene and naphthalene rings. The heterocyclic groups represented by are preferably monocyclic or fused ring, saturated or $R^2$ unsaturated, aromatic or non-aromatic heterocyclic groups while the heterocycles in these groups include pyridine, pyrimidine, imidazole, pyrazole, quinoline, isoquinoline, benzimidazole, thiazole, benzothiazole, piperidine, triazine, morpholine, and piperazine rings.

Aryl and alkyl groups are most preferred as $R^2$.

The groups represented by RX may have substituents. Exemplary substituents include halogen atoms (e.g., fluorine, chlorine, bromine and iodine), alkyl groups (inclusive of aralkyl, cycloalkyl and active methine groups), alkenyl groups, alkynyl groups, aryl groups, heterocyclic groups, heterocyclic groups containing a quaternized nitrogen atom (e.g., pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (inclusive of groups having recurring ethylenoxy or propylenoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy)carbonylamino groups, sulfamoylamino groups, semicarbazide groups, thiosemicarbazide groups, hydrazino groups, quaternary ammonio groups, oxamoylamino groups, (alkyl or aryl)sulfonylureido groups, acylureido groups, acylsulfamoylamino groups, nitro groups, mercapto groups, (alkyl, aryl or heterocyclic) thio groups, (alkyl or aryl)sulfonyl groups, (alkyl or aryl)sulfinyl groups, sulfo groups or salts thereof, sulfamoyl groups, acylsulfamoyl groups, sulfonylsulfamoyl groups or salts thereof, and groups containing a phosphoramide or phosphate structure. These substituents may be further substituted with such substituents.

Preferred substituents that $R^2$ may have include, where $R^2$ is an aromatic or heterocyclic group, alkyl (inclusive of active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

Where $R^2$ is an aliphatic group, preferred substituents include alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (inclusive of salts thereof), (alkyl, aryl or heterocyclic) thio, sulfo (inclusive of salts thereof), sulfamoyl, halogen, cyano, and nitro groups.

In formula (H), $R^1$ is hydrogen or a block group. Examples of the block group include aliphatic groups (e.g., alkyl, alkenyl and alkynyl groups), aromatic groups (monocyclic or fused ring aryl groups), heterocyclic groups, alkoxy, aryloxy, amino and hydrazino groups.

The alkyl groups represented by $R^1$ are preferably substituted or unsubstituted alkyl groups having 1 to 10 carbon atoms, for example, methyl, ethyl, trifluoromethyl, difluoromethyl, 2-carboxytetrafluoroethyl, pyridiniomethyl, difluoromethoxymethyl, difluorocarboxymethyl, 3-hydroxypropyl, 3-methanesulfonamidopropyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl, and methylthiodiphenylmethyl groups. The alkenyl groups are preferably those having 1 to 10 carbon atoms, for example, vinyl, 2-ethoxycarbonylvinyl, and 2-trifluoro-2-methoxycarbonylvinyl groups. The alkynyl groups are preferably those having 1 to 10 carbon atoms, for example, ethynyl and 2-methoxycarbonylethynyl groups. The aryl groups are preferably monocyclic or fused ring aryl groups, especially those containing a benzene ring, for example, phenyl, perfluorophenyl, 3,5-dichlorophenyl, 2-methanesulfonamidophenyl, 2-carbamoylphenyl, 4,5-dicyanophenyl, 2-hydroxymethylphenyl, 2,6-dichloro-4-cyanophenyl, and 2-chloro-5-octylsulfamoylphenyl groups.

The heterocyclic groups represented by $R^1$ are preferably 5- and 6-membered, saturated or unsaturated, monocyclic or fused ring, heterocyclic groups containing at least one of nitrogen, oxygen and sulfur atoms, for example, morpholino, piperidino (N-substituted), imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, and quinolyl groups.

The alkoxy groups are preferably those having 1 to 8 carbon atoms, for example, methoxy, 2-hydroxyethoxy, benzyloxy, and t-butoxy groups. The aryloxy groups are preferably substituted or unsubstituted phenoxy groups. The amino groups are preferably unsubstituted amino, alkylamino having 1 to 10 carbon atoms, arylamino, and saturated or unsaturated heterocyclic amino groups (inclusive of nitrogenous heterocyclic amino groups containing a quaternized nitrogen atom). Examples of the amino group include 2,2,6,6-tetramethylpiperidin-4-ylamino, propylamino, 2-hydroxyethylamino, anilino, o-hydroxyanilino, 5-benzotriazolylamino, and N-benzyl-3-pyridinioamino groups. The hydrazino groups are preferably substituted or unsubstituted hydrazino groups and substituted or unsubstituted phenylhydrazino groups (e.g., 4-benzenesulfonamidophenylhydrazino).

The groups represented by $R^1$ may be substituted ones, with examples of the substituent being as exemplified for the substituent on $R^2$.

In formula (H) , $R^1$ may be such a group as to induce cyclization reaction to cleave a $G^1$—$R^1$ moiety from the remaining molecule to generate a cyclic structure containing the atoms of the —$G^1$—$R^1$ moiety. Such examples are described in JP-A 29751/1988, for example.

The hydrazine derivative of formula (H) may have incorporated therein a group capable of adsorbing to silver halide. Such adsorptive groups include alkylthio, arylthio, thiourea, thioamide, mercapto heterocyclic and triazole groups as described in U.S. Pat. No. 4,385,108 and 4,459,347, JP-A-195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. These adsorptive groups to silver halide may take the form of precursors. Such precursors are exemplified by the groups described in JP-A 285344/1990.

$R^1$ and $R^2$ in formula (H) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R^1$ or $R^2$ in formula (H) may have a plurality of hydrazino groups as a substituent. In this case, the compounds of formula (H) are polymeric with respect to hydrazino groups. Exemplary polymeric compounds are described in JP-A 86134/1989, 16938/1992, 197091/1993, WO 95-32452 and 95-32453, Japanese Patent Application Nos. 351132/1995, 351269/1995, 351168/1995, 351287/1995, and 351279/1995.

$R^1$ or $R^2$ in formula (H) may contain a cationic group (e.g., a group containing a quaternary ammonio group and a nitrogenous heterocyclic group containing a quaternized nitrogen atom), a group containing recurring ethylenoxy or propylenoxy units, an (alkyl, aryl or heterocyclic) thio group, or a group which is dissociable with a base (e.g., carboxy, sulfo, acylsulfamoyl, and carbamoylsulfamoyl). Exemplary compounds containing such a group are described in, for example, in JP-A 234471/1995, 333466/1993, 19032/1994, 19031/1994, 45761/1993, 259240/1991, 5610/1995, and 244348/1995, U.S. Pat. No. 4,994,365 and 4,988,604, and German Patent No. 4006032.

In formula (H) , each of $A^1$ and $A^2$ is a hydrogen atom, a substituted or unsubstituted alkyl- or arylsulfonyl group having up to 20 carbon atoms (preferably a phenylsulfonyl group or a phenylsulfonyl group substituted such that the sum of Hammette's substituent constants may be −0.5 or more), or a substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxy group and sulfo group). Most preferably, both $A^1$ and $A^2$ are hydrogen atoms.

The preferable range of the hydrazine derivatives of the general formula (H) is described.

In formula (H), $R^2$ is preferably phenyl or substituted alkyl of 1 to 3 carbon atoms.

Where $R^2$ represents phenyl groups, preferred substituents thereon include nitro, alkoxy, alkyl, acylamino, ureido, sulfonamide, thioureido, carbamoyl, sulfamoyl, carboxy (or salts thereof), sulfo (or salts thereof), alkoxycarbonyl, and chloro groups.

Where $R^2$ represents substituted phenyl groups, it is preferred that the substituents be, directly or via a linking group, replaced by at least one substituent selected from ballast groups, adsorptive groups to silver halide, quaternary ammonio-containing groups, nitrogenous heterocyclic groups containing a quaternized nitrogen atom, groups containing recurring ethylenoxy units, (alkyl, aryl or heterocyclic) thio groups, nitro groups, alkoxy groups, acylamino groups, sulfonamide groups, dissociable groups (e.g., carboxy, sulfo, acylsulfamoyl, and carbamoylsulfamoyl), and hydrazino groups (groups represented by —NHNH—$G^1$—$R^1$) capable of forming a polymer.

Where $R^2$ represents substituted alkyl groups of 1 to 3 carbon atoms, it is more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R^2$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Most preferably, $R^2$ in formula (H) represents substituted phenyl groups.

In formula (H), $m_1$ is equal to 0 or 1. When $m_1$ is 0, $R^1$ represents aliphatic, aromatic or heterocyclic groups. When ml is 0, $R^1$ more preferably represents phenyl groups or substituted alkyl groups of 1 to 3 carbon atoms. The preferred ranges of these groups are the same as the preferred range of $R^2$. Preferably $m_1$ is equal to 1.

Where $R^2$ is a phenyl group and $G^1$ is —CO—, the groups represented by $R^1$ are preferably selected from hydrogen, alkyl, alkenyl, alkynyl, aryl and heterocyclic groups, more preferably from hydrogen, alkyl and aryl groups, and most preferably from hydrogen atoms and alkyl groups. Where $R^1$ represents alkyl groups, preferred substituents thereon are halogen, alkoxy, aryloxy, alkylthio, arylthio, and carboxy groups.

Where $R^2$ is a substituted methyl group and $G^1$ is —CO—, the groups represented by $R^1$ are preferably selected from hydrogen, alkyl, aryl, heterocyclic, alkoxy, and amino groups (including unsubstituted amino, alkylamino, arylamino and heterocyclic amino groups), more preferably from hydrogen, alkyl, aryl, heterocyclic, alkoxy, alkylamino, arylamio and heterocyclic amino groups. Where $G^1$ is —COCO—, independent of $R^2$, $R^1$ is preferably selected from alkoxy, aryloxy, and amino groups, more preferably from substituted amino groups, specifically alkylamino, arylamino and saturated or unsaturated heterocyclic amino groups.

Where $G^1$ is —$SO_2$—, independent of $R^2$, $R^1$ is preferably selected from alkyl, aryl and substituted amino groups.

In formula (H), $G^1$ is preferably —CO— or —COCO—, and most preferably —CO—.

Illustrative, non-limiting, examples of the compound represented by formula (H) are given below.

TABLE 1

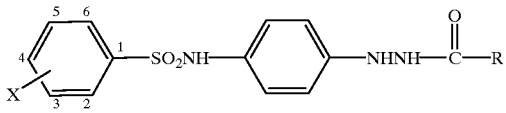

| | | R = | | | |
|---|---|---|---|---|---|
| | X = | —H | —$C_2F_4$—COOH or (—$C_2F_4$—$COO^{\ominus}K^{\oplus}$) | 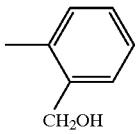 | 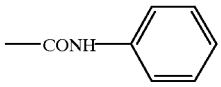 |
| 1 | 3-NHCO—$C_9H_{19}$(n) | 1a | 1b | 1c | 1d |
| 2 | 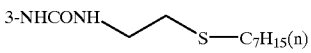 | 2a | 2b | 2c | 2d |

TABLE 1-continued
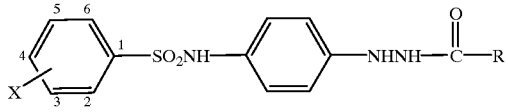
| | X = | R = —H | —$C_2F_4$—COOH or (—$C_2F_4$—$COO^{\ominus}K^{\oplus}$) | 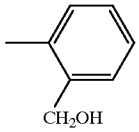 | 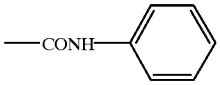 |
|---|---|---|---|---|---|
| 3 | 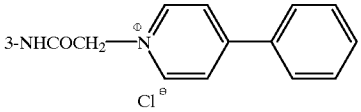 | 3a | 3b | 3c | 3d |
| 4 | 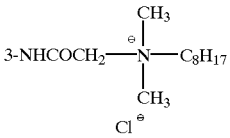 | 4a | 4b | 4c | 4d |
| 5 | 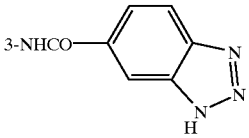 | 5a | 5b | 5c | 5d |
| 6 | 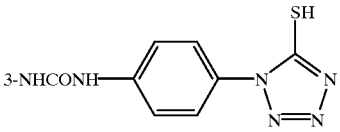 | 6a | 6b | 6c | 6d |
| 7 | 2,4-$(CH_3)_2$-3-$SC_2H_4$—$(OC_2H_4)_4$—$OC_8H_{17}$ | 7a | 7b | 7c | 7d |
TABLE 2
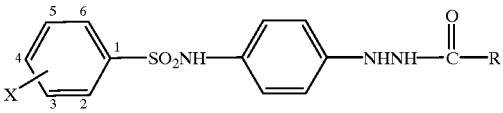
| | X = | R = —H | —$CF_2H$ | 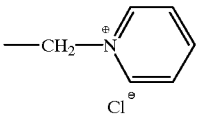 | 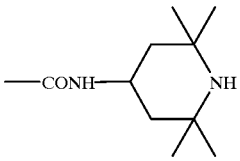 |
|---|---|---|---|---|---|
| 8 | 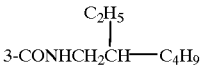 | 8a | 8e | 8f | 8g |
| 9 | 6-$OCH_3$-3-$C_5H_{11}$(t) | 9a | 9e | 9f | 9g |

TABLE 2-continued
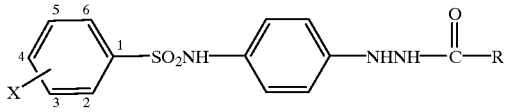
| | X = | R = —H | —$CF_2H$ | —$CH_2$—$N^{\oplus}$ $Cl^{\ominus}$ | —CONH— NH |
|---|---|---|---|---|---|
| 10 | 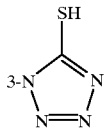 | 10a | 10e | 10f | 10g |
| 11 | 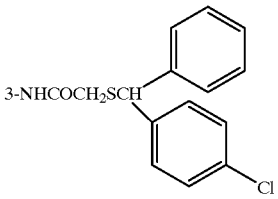 | 11a | 11e | 11f | 11g |
| 12 | 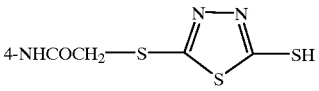 | 12a | 12e | 12f | 12g |
| 13 | 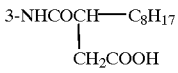 | 13a | 13e | 13f | 13g |
| 14 | 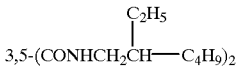 | 14a | 14e | 14f | 14g |
TABLE 3
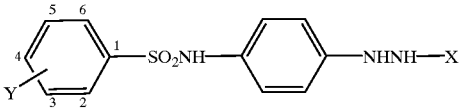
| | Y = | X = —CHO | —$COCF_3$ | —$SO_2CH_3$ | —$P(OC_2H_5)_2$ |
|---|---|---|---|---|---|
| 15 | 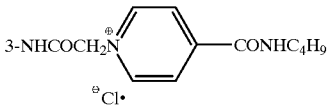 | 15a | 15h | 15i | 15j |

TABLE 3-continued
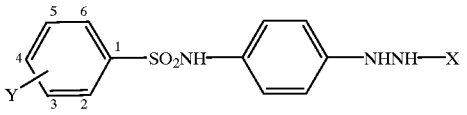
| | Y = | X = —CHO | —$COCF_3$ | —$SO_2CH_3$ | —P(O)$(OC_2H_5)_2$ |
|---|---|---|---|---|---|
| 16 | 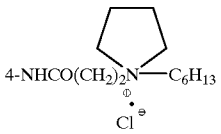 | 16a | 16h | 16i | 16j |
| 17 | 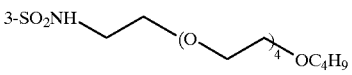 | 17a | 17h | 17i | 17j |
| 18 | 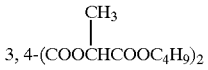 | 18a | 18h | 18i | 18j |
| 19 | 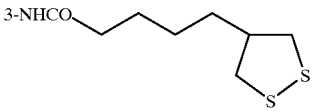 | 19a | 19h | 19i | 19j |
| 20 | 3-$NHSO_2NH$—$C_8H_{17}$ | 20a | 20h | 20i | 20j |
| 21 | 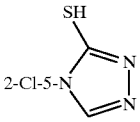 | 21a | 21h | 211 | 21j |

TABLE 4
| | | R = | | | |
|---|---|---|---|---|---|
| | | —H | —$CF_3$ | 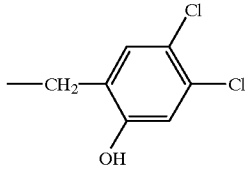 | 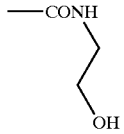 |
| 22 | 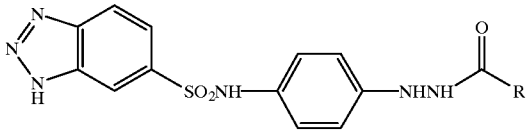 | 22a | 22h | 22k | 22l |
| 23 | 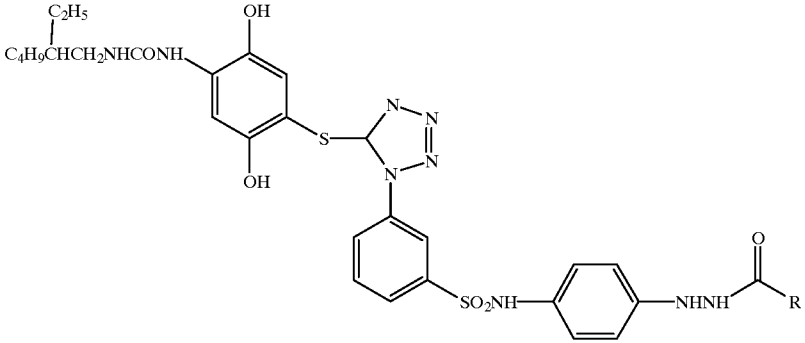 | 23a | 23h | 23k | 23l |

TABLE 4-continued
| | | R = | | | |
|---|---|---|---|---|---|
| | | —H | —$CF_3$ | 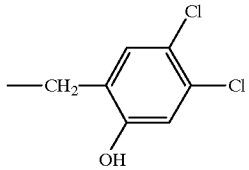 | 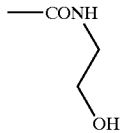 |
| 24 | 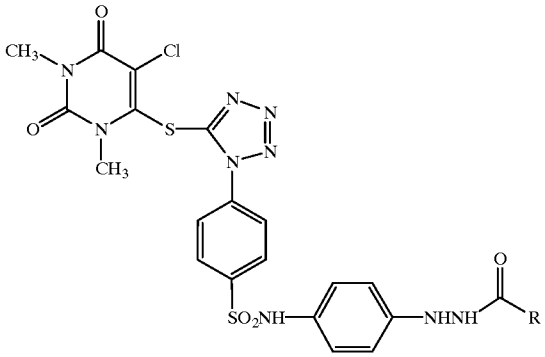 | 24a | 24h | 24k | 24l |
| 25 | 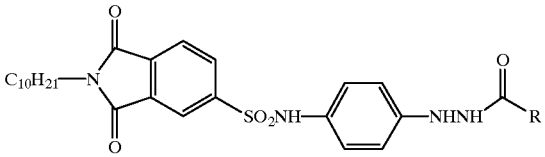 | 25a | 25h | 25k | 25l |
| 26 | 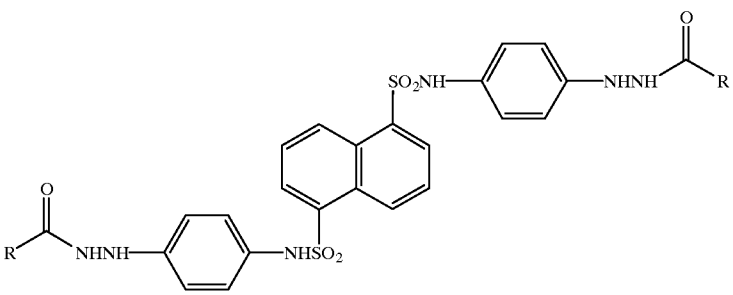 | 26a | 26h | 26k | 26l |

TABLE 4-continued
| | | R = | | | |
|---|---|---|---|---|---|
| | | —H | —$CF_3$ | 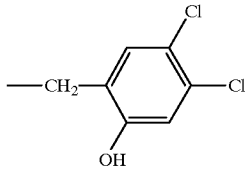 | 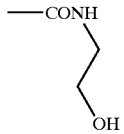 |
| 27 | 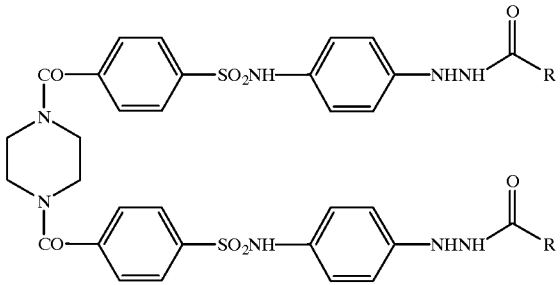 | 27a | 27h | 27k | 27l |
| 28 | 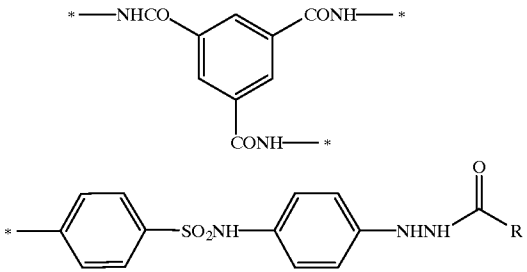 | 28a | 28h | 28k | 28l |

TABLE 5
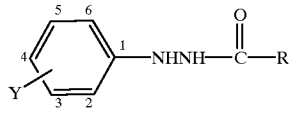
| | Y = | R = —H | —$CH_2OCH_3$ | 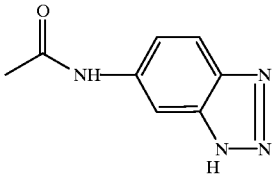 | 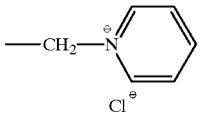 |
|---|---|---|---|---|---|
| 29 | 4-NHC(=S)NH—$C_8H_{17}$(n) | 29a | 29m | 29n | 29f |
| 30 | 4-NHP(=O)($OCH_2$—C$_6$H$_4$)$_2$ | 30a | 30m | 30n | 30f |
| 31 | 4-NHCONH—$(CH_2)_3O$—C$_6$H$_4$—C(CH$_3$)$_2$—CH$_3$ | 31a | 31m | 31n | 31f |
| 32 | 4-OH<br>3-NHCONH$CH_2$CH($C_2H_5$)—$C_4H_9$ | 32a | 32m | 32n | 32f |
| 33 | 4-$NHSO_2(CH_2)_2NHCO$—C$_6$H$_4$— 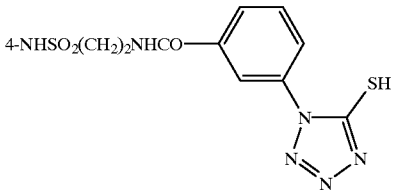 | 33a | 33m | 33n | 33f |

TABLE 5-continued
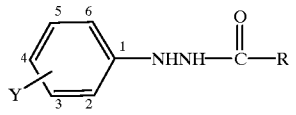
| | Y = | R = —H | —$CH_2OCH_3$ | 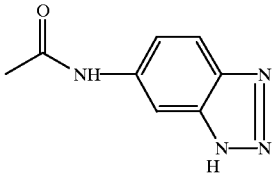 | 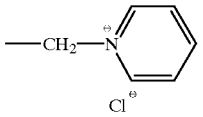 |
|---|---|---|---|---|---|
| 34 | 4-$OCH_2$ 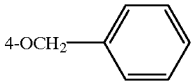 | 34a | 34m | 34n | 34f |
| 35 | 4-NHCONHN( 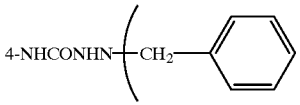 )$_2$ | 35a | 35m | 35n | 35f |

TABLE 6
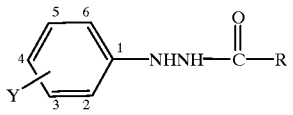
| | Y = | R = —H | —$CF_2SCH_3$ | —$CONHCH_3$ | 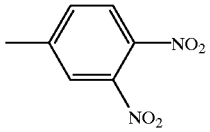 |
|---|---|---|---|---|---|
| 36 | 2-$NHSO_2CH_3$— <br> 4-$NHCONH(CH_2)_3$— 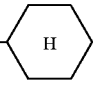 | 36a | 36o | 36p | 36q |
| 37 | 2-$OCH_3$- <br> 4-$NHSO_2C_{12}H_{25}$ | 37a | 37o | 37p | 37q |
| 38 | 3-$NHCOC_{11}H_{23}$- <br> 4-$NHSO_2CF_3$ | 38a | 38o | 38p | 38q |
| 39 | 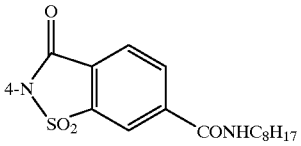 | 39a | 39o | 39p | 39q |
| 40 | 4-$OCO(CH_2)_2COOC_6H_{13}$ | 40a | 40o | 40p | 40q |
| 41 | 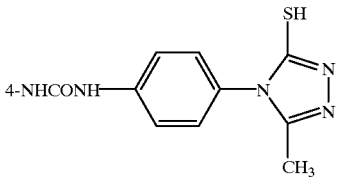 | 41a | 41o | 41p | 41q |
| 42 | 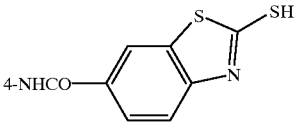 | 42a | 42o | 42p | 42q |
TABLE 7
43
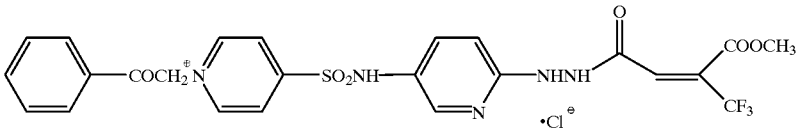
44
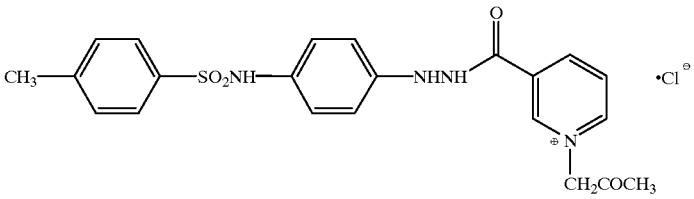

TABLE 7-continued
45
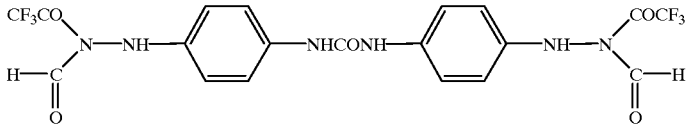
46
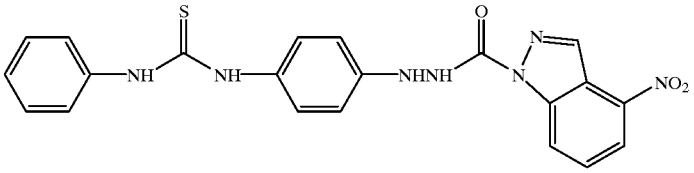
47
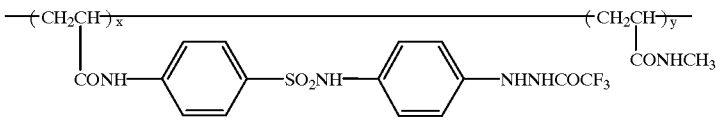
X:Y = 3:97
average molecular weight ~100,000
48
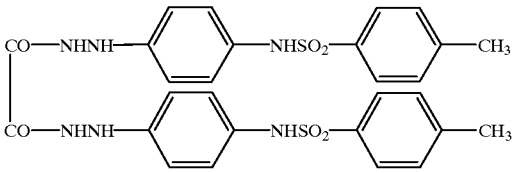
49
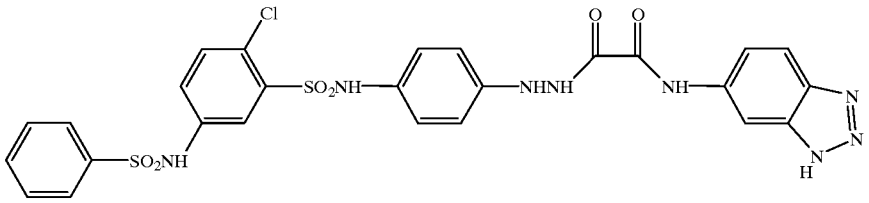
50
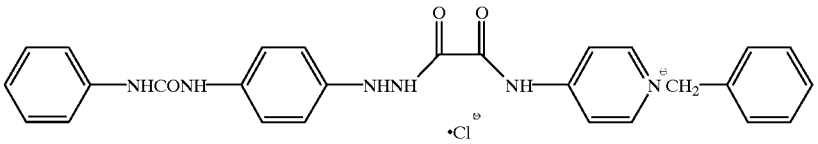
TABLE 8
51
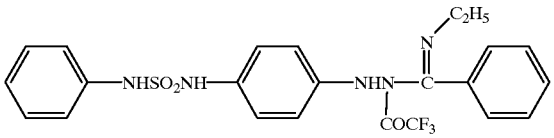
52
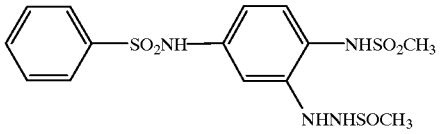

TABLE 8-continued
| | |
|---|---|
| 53 | 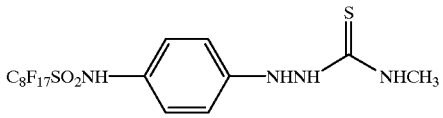 |
TABLE 9
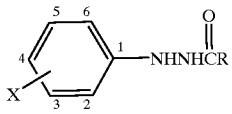
| | | R = | | | |
|---|---|---|---|---|---|
| | Y = | —H | —$CH_2OCH_3$ | —$CH_2O$— 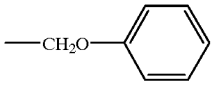 | —$CONHC_3H_7$ |
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 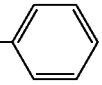 | 58a | 58m | 58r | 58s |
| 59 | 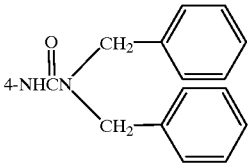 | 59a | 59m | 59r | 59s |
TABLE 10
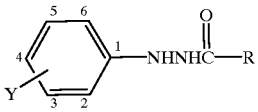
| | | R = | | | |
|---|---|---|---|---|---|
| | Y = | —H | 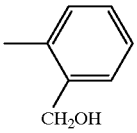 | —$CH_2$— 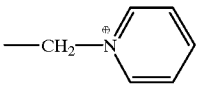 •$Cl^{\ominus}$ | —CONH— 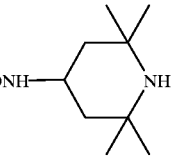 |
| 60 | 2-$OCH_3$ 5-$OCH_3$ | 60a | 60c | 60f | 60g |
| 61 | 4-$C_8H_{17}$(t) | 61a | 61c | 61f | 61g |
| 62 | 4-$OCH_3$ | 62a | 62c | 62f | 62g |
| 63 | 3-$NO_2$ | 63a | 63c | 63f | 63g |

TABLE 10-continued
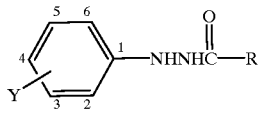
| | Y = | R = —H | 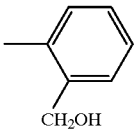 | 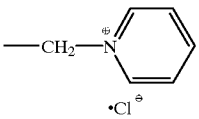 | 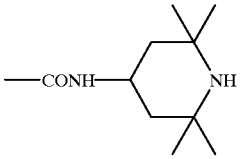 |
|---|---|---|---|---|---|
| 64 | 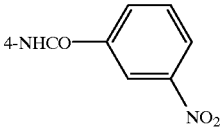 | 64a | 64c | 64f | 64g |
| 65 | 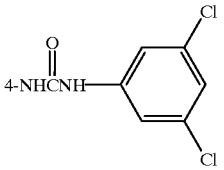 | 65a | 65c | 65f | 65g |
TABLE 11
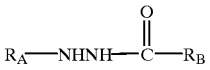
| | $R_A$ = | $R_B$ = —H | 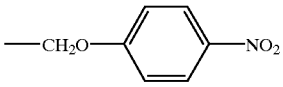 | 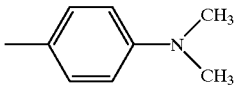 | 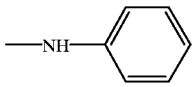 |
|---|---|---|---|---|---|
| 66 | 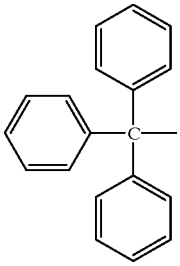 | 66a | 66u | 66v | 66t |

TABLE 11-continued
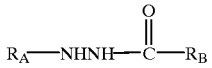
| | $R_A$ = | $R_B$ = —H | —$CH_2O$—⟨⟩—$NO_2$ | —⟨⟩—N($CH_3$)$_2$ | —NH—⟨⟩ |
|---|---|---|---|---|---|
| 67 | 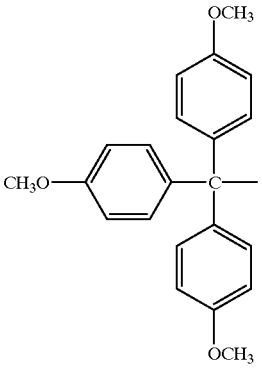 | 67a | 67u | 67v | 67t |
| 68 | 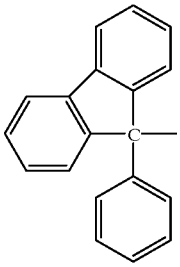 | 68a | 68u | 68v | 68t |
| 69 | 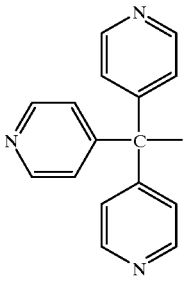 | 69a | 69u | 69v | 69t |

TABLE 11-continued
| | | $R_A$—NHNH—C(=O)—$R_B$ | | | |
|---|---|---|---|---|---|
| | | $R_B$ = | | | |
| | $R_A$ = | —H | —$CH_2O$— 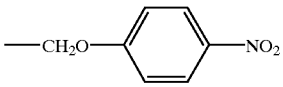 —$NO_2$ | — 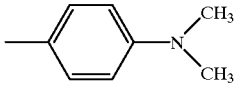 —N($CH_3$)($CH_3$) | —NH— 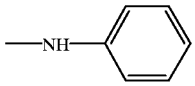 |
| 70 | 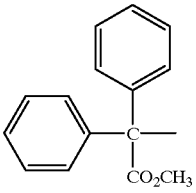 | 70a | 70u | 70v | 70t |
| 71 | 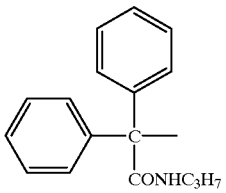 | 71a | 71u | 71v | 71t |
TABLE 12
| | | $R_A$—NHNH—C(=O)—$R_B$ | | | |
|---|---|---|---|---|---|
| | | $R_B$ = | | | |
| | $R_A$ = | —C(=O)$NHC_3H_7$ | —C(=O)O—$C_4H_9$(t) | —$OC_4H_9$(t) | — 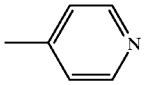 |
| 72 | 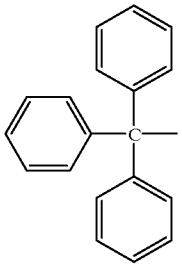 | 72s | 72x | 72y | 72w |

TABLE 12-continued
| | | $R_A$—NHNH—C(=O)—$R_B$ | | | |
|---|---|---|---|---|---|
| | | $R_B$ = | | | |
| | $R_A$ = | —C(=O)NHC$_3$H$_7$ | —C(=O)O—C$_4$H$_9$(t) | —OC$_4$H$_9$(t) | 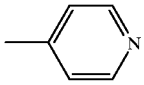 |
| 73 | 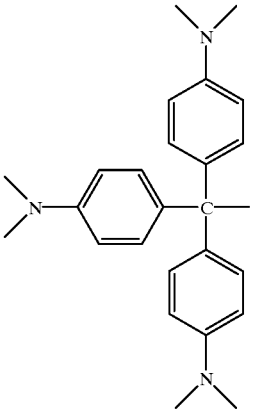 | 73s | 73x | 73y | 73w |
| 74 | 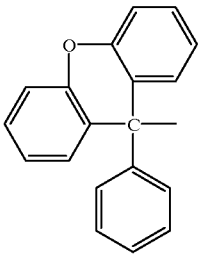 | 74s | 74x | 74y | 74w |
| 75 | 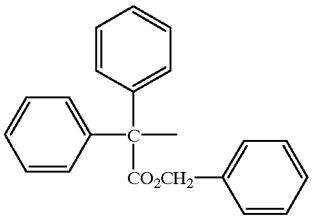 | 75s | 75x | 75y | 75w |

TABLE 12-continued
| | $R_A$ — NHNH — C(=O) — $R_B$ | | | |
|---|---|---|---|---|
| | $R_B$ = | | | |
| $R_A$ = | —C(=O)NHC$_3$H$_7$ | —C(=O)O—C$_4$H$_9$(t) | —OC$_4$H$_9$(t) | 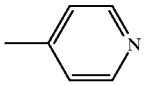 |
| 76 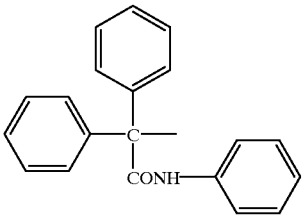 | 76s | 76x | 76y | 76w |
TABLE 13
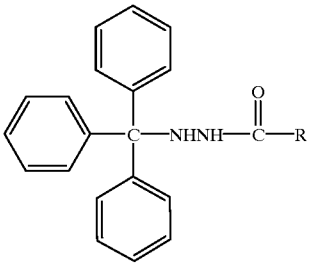
R =
| | |
|---|---|
| 77 | 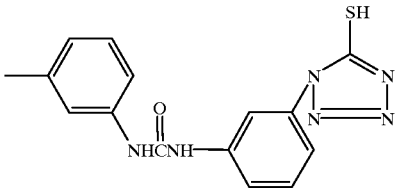 |
| 78 | —$CH_2SCH_2CH_2SO_2$— 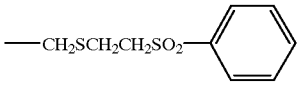 |
| 79 | —$CH_2OCH_2CH_2SCH_2CH_2OCH_3$ |
| 80 | —$CF_2CF_2COOH$ |
| 81 | —$CH_2OCH_2S$— 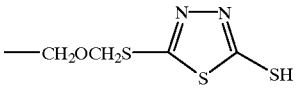 |
| 82 | —$CH_2$— 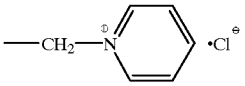 |
TABLE 14
| | |
|---|---|
| 83 | 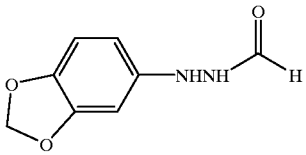 |
| 84 | 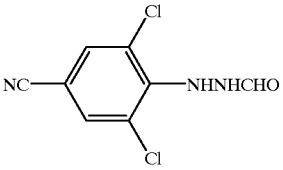 |
| 85 | 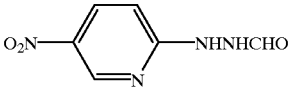 |
| 86 | 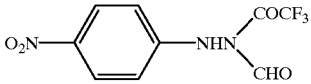 |
| 87 | 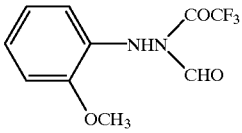 |
| 88 | 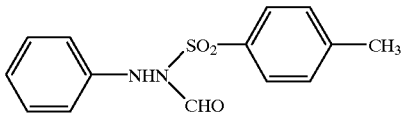 |

TABLE 15
89
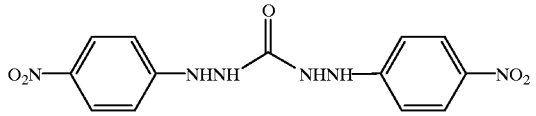
90
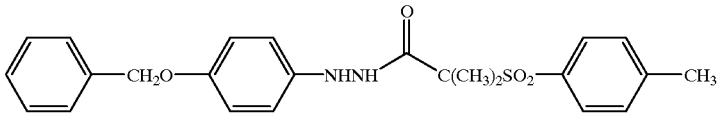
91
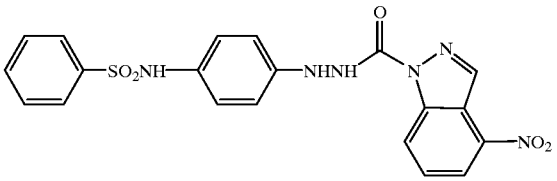
92
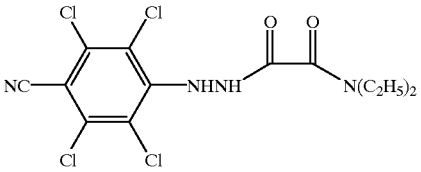
93
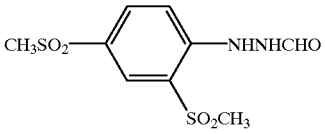
94
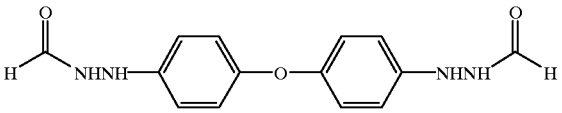

TABLE 16
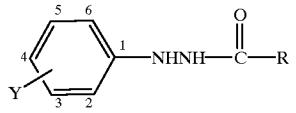
| | Y = | R = 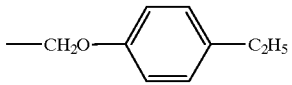 | 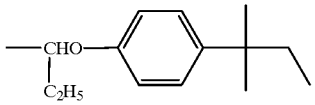 | 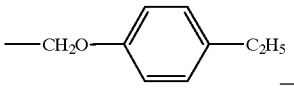 |  |
|---|---|---|---|---|---|
| 95 | 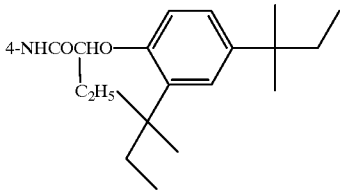 | 95-1 | 95-2 | 95-3 | 95-4 |
| 96 | 4-COOH | 96-1 | 96-2 | 96-3 | 96-4 |
| 97 | 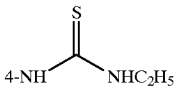 | 97-1 | 97-2 | 97-3 | 97-4 |

TABLE 16-continued
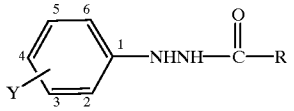
| | Y = | R = | | | |
|---|---|---|---|---|---|
| | | 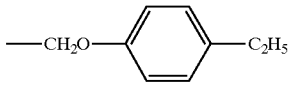 | 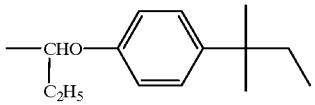 | 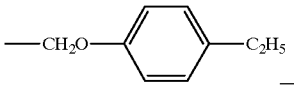 |  |
| 98 | 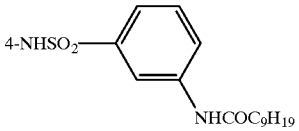 | 98-1 | 98-2 | 98-3 | 98-4 |
| 99 | 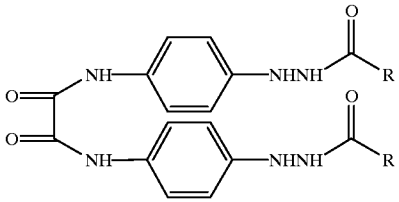 | 99-1 | 99-2 | 99-3 | 99-4 |
| 100 | 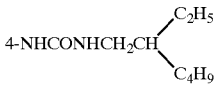 | 100-1 | 100-2 | 100-3 | 100-4 |

TABLE 17
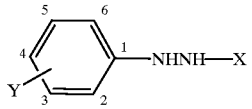
| | Y = | X = 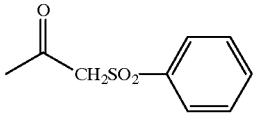 | 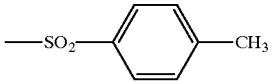 | 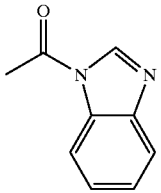 | 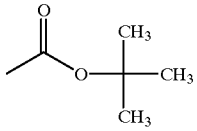 |
|---|---|---|---|---|---|
| 101 | 4-$NO_2$ | 101-5 | 101-6 | 101-7 | 101y |
| 102 | 2,4-$OCH_3$ | 102-5 | 102-6 | 102-7 | 102y |
| 103 | 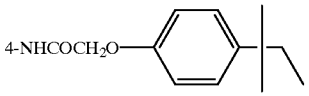 | 103-5 | 103-6 | 103-7 | 103y |

TABLE 17-continued
| | Y = | X = | | | |
|---|---|---|---|---|---|
| | | 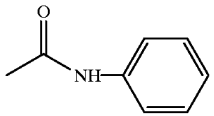 | 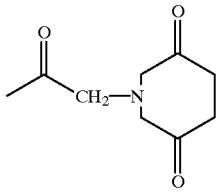 | 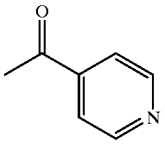 | 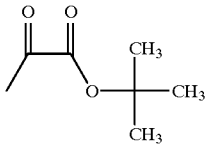 |
| 104 | 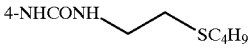 | 104-8 | 104-9 | 104w' | 104x |
| 105 | 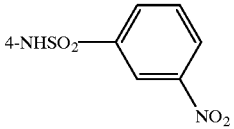 | 105-8 | 105-9 | 105w' | 105x |

TABLE 18
| | Y—NH NH—X | | | | |
|---|---|---|---|---|---|
| | | X = | | | |
| | Y = | 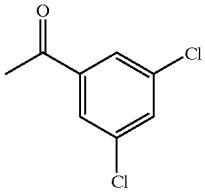 | 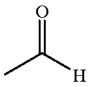 | 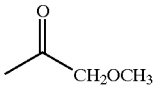 | 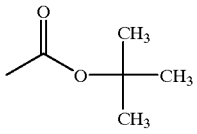 |
| 106 | 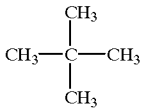 | 106-10 | 106a | 106m | 106y |
| 107 | 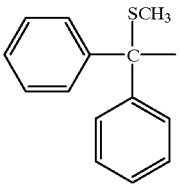 | 107-10 | 107a | 107m | 107y |
| 108 | 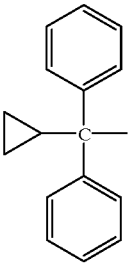 | 108-10 | 108a | 108m | 108y |
| 109 | 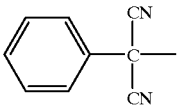 | 109-10 | 109a | 109m | 109y |
| 110 | 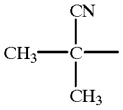 | 110-10 | 110a | 110m | 110y |
| 111 | 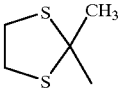 | 111-10 | 111a | 111m | 111y |

TABLE 19
| | | Y—NH NH—X | | | |
|---|---|---|---|---|---|
| | | X = | | | |
| | Y = | 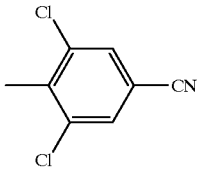 | 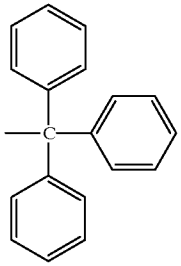 | 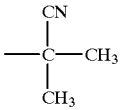 | 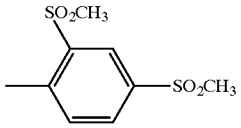 |
| 112 | 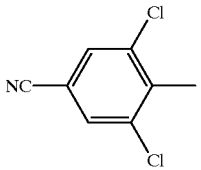 | 112-11 | 112-12 | 112-13 | 112-14 |
| 113 | 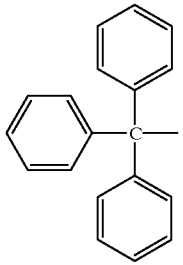 | 113-11 | 113-12 | 113-13 | 113-14 |
| 114 | 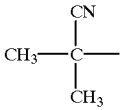 | 114-11 | 114-12 | 114-13 | 114-14 |

TABLE 19-continued
| | | Y—NH NH—X | | | |
|---|---|---|---|---|---|
| | | X = | | | |
| | Y = | 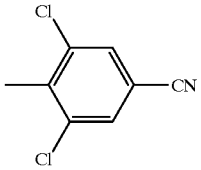 | 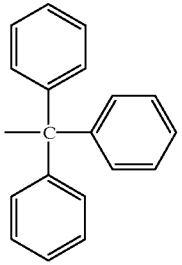 | 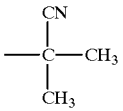 | 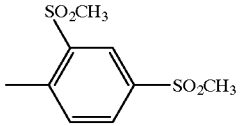 |
| 115 | 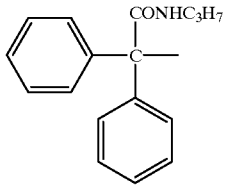 | 115-11 | 115-12 | 115-13 | 115-14 |
| 116 | 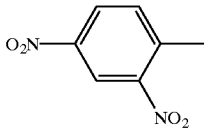 | 116-11 | 116-12 | 116-13 | 116-14 |
| 117 | 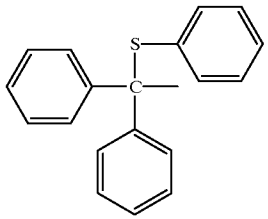 | 117-11 | 117-12 | 117-13 | 117-14 |

TABLE 20
118
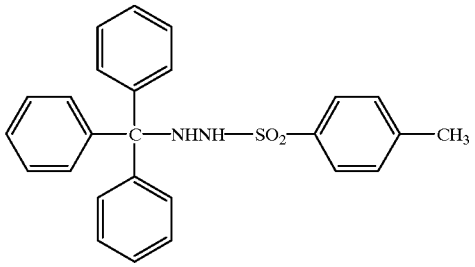
119
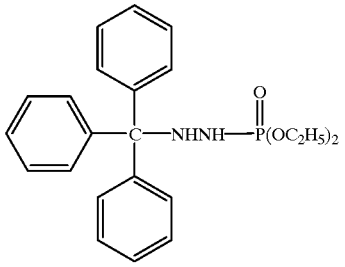
120
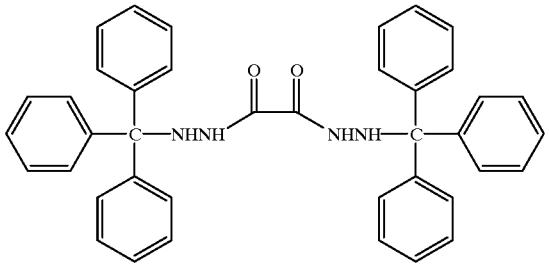
121
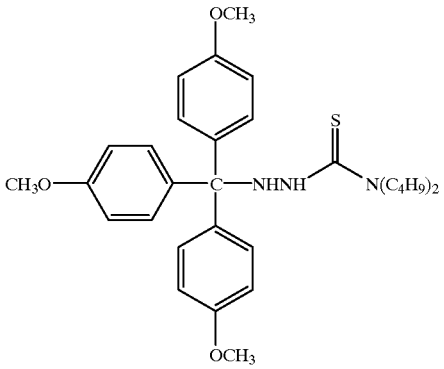

TABLE 20-continued
| | |
|---|---|
| 122 | 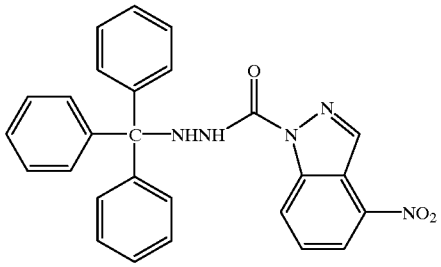 |
| 123 | 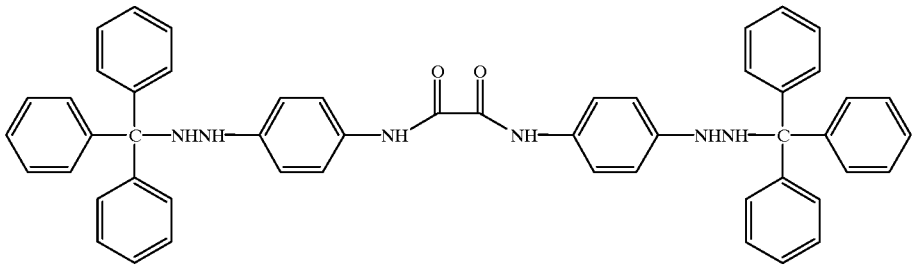 |

TABLE 21
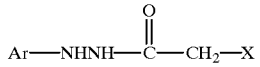
| | | X = | | | | | |
|---|---|---|---|---|---|---|---|
| | Ar = | —OH | —SH | —$NHCOCF_3$ | —$NHSO_2CH_3$ | —$NHSO_2ph$ | —$N(CH_3)_2$ |
| 124 | 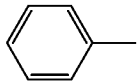 | 124a | 124b | 124c | 124d | 124e | 124f |
| 125 | 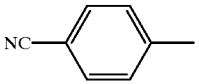 | 125a | 125b | 125c | 125d | 125e | 125f |
| 126 | 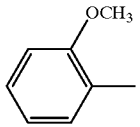 | 126a | 126b | 126c | 126d | 126e | 126f |
| 127 | 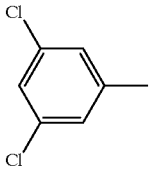 | 127a | 127b | 127c | 127d | 127e | 127f |

TABLE 21-continued
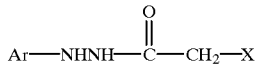
| | | X = | | | | | |
|---|---|---|---|---|---|---|---|
| | Ar = | —OH | —SH | —NHCOCF$_3$ | —NHSO$_2$CH$_3$ | —NHSO$_2$ph | —N(CH$_3$)$_2$ |
| 128 | 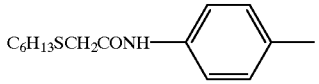 | 128a | 128b | 128c | 128d | 128e | 128f |
| 129 | 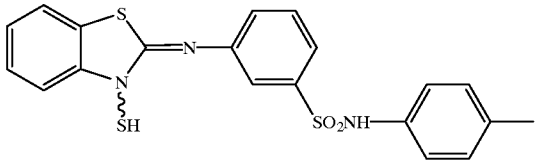 | 129a | 129b | 129c | 129d | 129e | 129f |
| 130 | 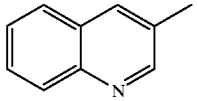 | 130a | 130b | 130c | 130d | 130e | 130f |
| 131 | 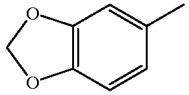 | 131a | 131b | 131c | 131d | 131e | 131f |

TABLE 21-continued
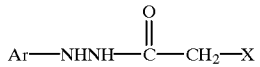
| | Ar = | X = —OH | —SH | —NHCOCF$_3$ | —NHSO$_2$CH$_3$ | —NHSO$_2$ph | —N(CH$_3$)$_2$ |
|---|---|---|---|---|---|---|---|
| 132 | 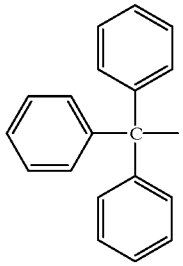 | 132a | 132b | 132c | 132d | 132e | 132f |
| 133 | 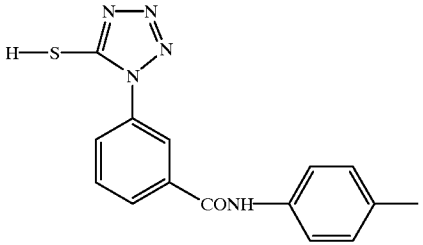 | 133a | 133b | 133c | 133d | 133e | 133f |
| 134 | 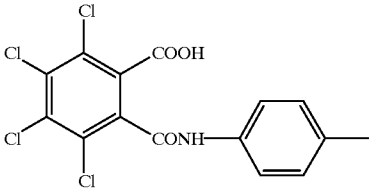 | 134a | 134b | 134c | 134d | 134e | 134f |

TABLE 22

135

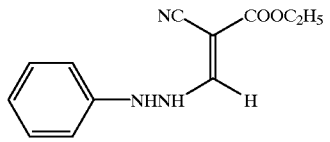

136

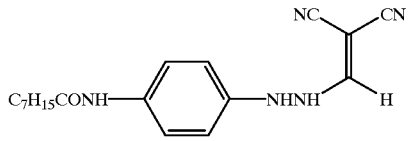

137

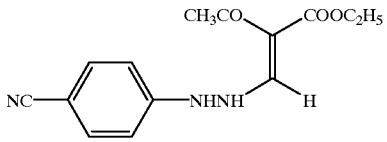

The compounds of formula (H) may be used alone or in admixture of two or more.

In addition to the above-described ones, the following hydrazine derivatives are also preferable for use in -he practice of the invention. If desired, any of the following hydrazine derivatives may be used in combination with the hydrazine derivatives of formula (H). The hydrazine derivatives which are used herein can be synthesized by various methods as described in the following patents.

Exemplary hydrazine derivatives which can be used herein include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 or the same; the compounds of the general formula (I) in JP-A 5610/1995, more specifically compounds I-1 to 1-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K.K., Mar. 22, 1991, pages 25–34 and Compounds D-2 and D-39 described in JP-A 86354/1937, pages 6–7.

In the practice of the invention, the hydrazine nucleating agent is used as solution in a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method may be used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in a suitable solvent in a ball mill, colloidal mill or ultrasonic mixer.

The hydrazine nucleating agent may be added to an image forming layer or any other binder layer on the image forming layer side of a support, and preferably to the image forming layer or a binder layer disposed adjacent thereto.

The nucleating agent is preferably used in an amount of $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol per mol of silver halide.

Also in the practice of the invention, ultrahigh contrast promoting agents may be used in combination with the contrast enhancers for forming ultrahigh contrast images. Such ultrahigh contrast promoting agents include the amine compounds described in U.S. Pat. No. 5,545,505, specifically Compounds AM-1 to AM-S therein, the hydroxamic acids described in U.S. Pat. No. 5,545,507, specifically HA-1 to HA-11 therein, the acrylonitriles described in U.S. Pat. No. 5,545,507, specifically CN-1 to CN-13 therein, the hydrazine compounds described in U.S. Pat. No. 5,558,983, specifically CA-1 to CA-6 therein, the onium salts described in Japanese Patent Application No. 132836/1996, specifically A-1 to A-42, B-1 to B-27 and C-1 to C-14.

The synthesis methods, addition methods, and addition amounts of these ultrahigh contrast enhancers and ultrahigh contrast promoting agents are as described in the above-listed patents.

Sensitizing dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and process cameras.

Exemplary dyes for spectral sensitization to red light include compounds I-1 to 1-38 described in JP-A 18726,/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He—Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole or imidazole nucleus. Preferred examples of the useful merocyanine dye contain an acidic nucleus such as a thiohydantoin, rhodanine, oxazolidlnedione, thiazolinedione, barbituric acid, thiazolinone, malononitrile or pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. Nos. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. No. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization in addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/198, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at an-, step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably 10-4 to 10-l mol per mol of the silver halide in the photosensitive layer serving as the image forming layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in USP 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 12032811975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of 1 nmol to 1 mmol, more preferably 10 nmol to 100 μmol per mol of silver coated.

Still further, the thermographic imaging element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051,1996, 151241/1996, and 151242/1996. The benzoic acid type compound may be added to any site in the recording element, preferably to a layer on the same side as the photosensitive layer serving as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acing type compound may be added in any desired amount, preferable 1 μmol to 2 mol, more preferably 1 mmol to 0.5 mol per mol of silver.

In the imaging element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented big Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer (serving as the image forming layer) in amounts of 0.0001 to 1.0 mol, more preferably 0.001 to 0.3 mol per mol of silver.

In the image forming layer, typically photosensitive layer, polyhydric alcohols (e.g., glycerin and diols as described in U.S. Pat. No. 2,960,404), fatty acids and esters thereof as described in U.S. Pat. No. 2,588,765 and 3,121,060, and silicone resins as described in BP 955,061 may be added as a plasticizer and lubricant.

The thermographic photographic emulsion used in the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion (or photosensitive) layers are distinctly supported by providing a functional or non-functional barrier layer therebetween as described in U.S. Pat. No. 4,460,681.

In the photosensitive layer serving as the image recording layer, a variety of dyes and pigments may be used from the standpoints of improving tone and preventing irradiation. Any desired dyes and pigments may be used in the invention. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 μg to 1 g per square meter of the imaging element.

In the practice of the invention, an antihalation layer may be disposed on the side of the photosensitive layer remote from the light source. The antihalation layer preferably has a maximum absorbance of 0.3 to 2 in the desired wavelength range, more preferably an absorbance of 0.5 to 2 at the exposure wavelength, and an absorbance of 0.001 to less than 0.5 in the visible region after processing, and is also preferably a layer having an optical density of 0.001 to less than 0.3.

Where an antihalation dye is used in the invention, it may be selected from various compounds insofar as it has the desired absorption in the wavelength range, is sufficiently low absorptive in the visible region after processing, and provides the antihalation layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In one preferred embodiment, the thermographic image recording element of the invention is a one-side image-recording element having at least one image forming layer such as a silver halide emulsion-containing photosensitive layer on one side and a back layer on the other side of the support.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as previously described for the antihalation layer.

A backside resistive heating layer as described in U.S. Pat. No. 4,460,681 and 4,374,921 may be used in a photographic thermographic image recording system according to the present invention.

According to the invention, a hardener may be used in various layers including an image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

The thermographic image recording element of the invention may be developed by any desired method although ar is generally developed by heating after imagewise exposure. The preferred developing temperature is about 80 to 250° C., more preferably 100 to 140° C. The preferred developing time is about 1 to 180 seconds, more preferably about 10 to 90 seconds.

Any desired technique may be used for the exposure of the thermographic image recording element of the invention. The preferred light source for exposure is a laser, for example, a gas laser, YAG laser, dye laser or semiconductor laser. A semiconductor laser combined with a second harmonic generating device is also useful.

Upon exposure, the thermographic image recording element of the invention tends to generate interference fringes due to low haze. Known techniques for preventing generation of interference fringes are a technique of obliquely directing laser light to an image recording element as disclosed in JP-A 113548/1993 and the utilization of a multi-mode laser as disclosed in WO 95/31754. These techniques are preferably used herein.

Upon exposure of the thermographic image recording element of the invention, exposure is preferably made by overlapping laser light so that no scanning lines are visible, as disclosed in SPIE, Vol. 169, Laser Printing 116–128 (1979), JP-A 51043/1992, and WO 95/31754.

Developing apparatus

Referring to FIG. 1, there is schematically illustrated one exemplary heat developing apparatus for use in the processing of the thermographic image recording element according to the invention. FIG. 1 is a side elevation of the heat developing apparatus which includes a cylindrical heat drum 2 having a halogen lamp 1 received therein as a heating means, and an endless belt 4 trained around a plurality of feed rollers 3 so that a portion of the belt 4 is in close contact with the drum 2. A length of thermographic image recording element 5 is fed and guided by pairs of guide rollers to between the heat drum 2 and the belt 4. The element 5 is fed forward while it is clamped between the heat drum 2 and the belt 4. While the element 5 is fed forward, it is heated to the developing temperature whereby it is heat developed.

The element 5 exits at an exit 6 from between the heat drum 2 and the belt 4 where the element is released from bending by the circumferential surface of the heat drum 2. A correcting guide plate 7 is disposed in the vicinity of the exit 6 for correcting the element 5 into a planar shape. A zone surrounding the guide plate 7 is temperature adjusted so that the temperature of the element 5 may not lower below 90° C.

Disposed downstream of the exit 6 are a pair of feed rollers 8. A pair of planar guide plates 9 are disposed downstream of and adjacent to the feed rollers 8 for guiding the element 5 while keeping it planar. Another pair of feed rollers 10 are disposed downstream of and adjacent to the guide plates 9. The planar guide plates 9 have such a length that the element 5 is fully cooled, typically below 30° C., while it passes over the plates 9. The means associated with the guide plates 9 for cooling the element 5 are cooling fans 11.

Although the belt conveyor type heat developing apparatus has been described, the invention is not limited thereto and heat developing apparatus of varying constructions may be used.

EXAMPLE

Examples of the present invention are given below by way of illustration and not by way of limitation.

Example 1

(1) Preparation of support

Using terephthalic acid and ethylene glycol, a polyethylene terephthalate (PET) having an intrinsic viscosity of 0.66 as measured in a phenol/tetrachloroethane 6/4 (weight ratio) mixture at 25° C. was prepared in a conventional manner. After the PET was pelletized and dried at 130° C. for 4 hours, it was melted at 300° C., extruded through a T-shaped die, and quenched to form an unstretched film having a thickness sufficient to give a thickness of 120 $\mu$m after heat curing.

The film was longitudinally stretched by a factor of 3.3 by means of rollers having different circumferential speeds and then transversely stretched by a factor of 4.5 by means of a tenter. The temperatures in these stretching steps were 110° C. and 130° C., respectively. Thereafter, the film was heat cured by heating at 240° C. for 20 seconds and then transversely relaxed 4% at the same temperature. Thereafter, with the chuck of the tenter being slit and the opposite edges being knurled, the film was taken up under a tension of 4.8 kg/cm$^2$. In this way, a film of 2.4 mm wide, 3,500 m long and 120 $\mu$m thick was obtained in a roll form.

| | | |
|---|---|---|
| (2) | Subbing layer (a) | |
| | Polymer Latex 1<br>Styrene/butadiene/hydroxyethyl methacrylate/divinyl benzene = 67/30/2.5/0.5 wt %, Tg = 20° C. | 160 mg/m$^2$ |
| | 2,4-dichloro-6-hydroxy-s-triazine | 4 mg/m$^2$ |
| | Matte agent<br>(polystyrene, mean particle size 2.4 $\mu$m) | 3 mg/m$^2$ |
| | Subbing layer (b) | |
| | Alkali-treated gelatin<br>($Ca^{++}$ content 30 ppm, jelly strength 230 g) | 50 mg/m$^2$ |
| | Compound-1 | 10 mg/m$^2$ |

Compound-1

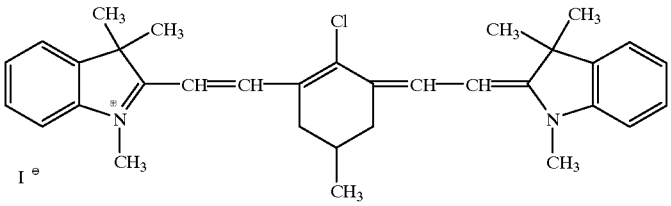

| | | |
|---|---|---|
| (3) | Conductive layer<br>(surface resistivity $10^9$ Ω at 25° C. and RH 25%) | |
| | Jurimer ET-410<br>(Nippon Junyaku K.K.), Tg = 52° C. | 38 mg/m$^2$ |
| | $SnO_2$/Sb<br>(9/1 weight ratio, mean particle size 0.25 $\mu$m) | 120 mg/m$^2$ |
| | Matte agent<br>(polymethyl methacrylate, mean particle size 5 $\mu$m) | 7 mg/m$^2$ |
| | Denacol EX-614B (Nagase Chemicals K.K.) | 13 mg/m$^3$ |
| (4) | Protective layer (back surface) | |
| | Chemipearl S-120<br>(Mitsui Petro-Chemical K.K.), Tg = 77° C. | 500 mg/m$^3$ |
| | Snowtex C (Nissan Chemical K.K.) | 40 mg/m$^3$ |
| | Denacol EX-614B (Nagase Chemicals K.K.) | 30 mg/m$^2$ |

On each surface of a support, the subbing layer (a) and the subbing layer (b) each were successively coated and dried at 180° C. for 4 minutes. On one (back) surface of the support where subbing layer (a) and subbing layer (b) had been coated, the conductive layer and the protective layer each were successively coated and dried at 180° C. for 4 minutes. There was obtained the PET support with the back/subbing layers.

(5) Heat treatment on feed (5-1) Heat treatment

The PET support with the back/subbing layers was fed at a feed speed of 20 m/min. through a heat treating zone of 200 m in overall length which was set at the temperature and tension described in Table 23.

(5-2) Post heat treatment

Subsequent to heat treatment (5-1), the PET support was post heat treated at the temperature and time described in Table 23 and taken up into a roll. The take-up tension was 10 kg/cm$^2$.

TABLE 23

| Support with back/subbing layer | Heat treatment Tension (kg/cm$^2$) | Heat treatment Temp. (° C.) | Post heat treatment Time (sec.) | Post heat treatment Temp. (° C.) | Dimensional change (%) on heating 120° C./30 sec. after heat treatment MD | Dimensional change (%) on heating 120° C./30 sec. after heat treatment TD | Waving of film after heat development |
|---|---|---|---|---|---|---|---|
| 1 | not heat treated | | not heat treated | | −0.150 | 0.800 | Waved |
| 2 | 3 | 130 | 15 | 40 | −0.005 | 0.015 | No |
| 3 | 5 | 130 | 15 | 40 | −0.008 | 0.019 | No |

TABLE 23-continued

| Support with back/ subbing layer | Heat treatment Tension (kg/cm²) | Heat treatment Temp. (° C.) | Post heat treatment Time (sec.) | Post heat treatment Temp. (° C.) | Dimensional change (%) on heating 120° C./30 sec. after heat treatment MD | Dimensional change (%) on heating 120° C./30 sec. after heat treatment TD | Waving of film after heat development |
|---|---|---|---|---|---|---|---|
| 4 | 7 | 130 | 15 | 40 | −0.010 | 0.025 | No |
| 5 | 10 | 130 | 15 | 40 | −0.025 | 0.035 | No |
| 6 | 3 | 160 | 15 | 40 | −0.005 | 0.014 | No |
| 7 | 3 | 200 | 15 | 40 | −0.003 | 0.010 | No |
| 8 | 3 | 220 | 15 | 40 | −0.030 | 0.025 | No |

On the subbing layer on the surface side, an image forming layer and a protective layer, described below, each were successively coated and dried at 65° C. for 3 minutes. In this way, there were obtained thermographic image-recording element samples as reported in Table 24.

Dye S-1

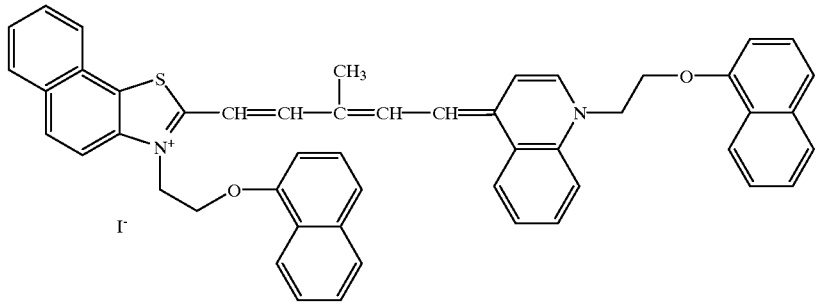

(6) Image forming layer

Silver halide grains

In 700 ml of water were dissolved 11 grams of phthalated gelatin, 30 mg of potassium bromide and 10 mg of sodium thiosulfonate. The solution was adjusted to pH 5.0 at a temperature of 35° C. To the solution, 159 ml of an aqueous solution containing 18.6 grams of silver nitrate and an aqueous solution containing 1 mol/liter of potassium bromide were added over 6.5 minutes by the controlled double jet method while maintaining the solution at pAg 7.7. Then, 476 ml of an aqueous solution containing 55.4 grams of silver nitrate and an aqueous halide solution containing 1 mol/liter of potassium bromide were added over 30 minutes by the controlled double jet method while maintaining the solution at pAg 7.7. After 1 gram of 4-hydroxy-6-methyl-1,3,3a,7-tetrazaindene was added, the pH of the solution was lowered to cause flocculation and sedimentation for desalting. The solution was adjusted to pH 5.9 and pAg 8.2 by adding 0.1 gram of phenoxyethanol. There were obtained cubic grains of silver bromide having a mean grain size of 0.12 μm, a coefficient of variation of the projected area diameter of 8%, and a (100) face proportion of 88%.

The thus obtained silver halide grains were heated at 60° C., to which $8.5\times10^{-4}$ mol of sodium thiosulfate was added per mol of silver. The emulsion was ripened for 120 minutes and then quenched to 40° C. Then, $1\times10^{-5}$ mol of Dye S-1, $5\times10^{-5}$ mol of 2-mercapto-5-methylbenzimidazole and $5\times10^{-5}$ mol of N-methyl-N'-{3-(mercaptotetrazolyl) phenyl}urea were added to the emulsion, which was quenched to 30° C., completing the preparation of a silver halide emulsion.

Organic acid silver dispersion

While a mixture of 4.4 grams of stearic acid, 39.4 grams of behenic acid, and 770 ml of distilled water was stirred at 90° C., 103 ml of 1N NaOH aqueous solution was added. Reaction was carried out for 240 minutes. The solution was cooled to 75° C. Next, 112.5 ml of an aqueous solution containing 19.2 grams of silver nitrate was added over 45 seconds to the solution, which was left to stand for 20 minutes and cooled to 30° C. Thereafter, the solids were separated by suction filtration and washed with water until the water filtrate reached a conductivity of 30 μS/cm. To the thus obtained solids, 100 grams of a 10 wt % aqueous solution of hydroxypropyl methyl cellulose was added. Water was further added to a total weight of 270 grams. This was roughly dispersed in an automated mortar, obtaining a crude organic acid silver dispersion. This crude organic acid silver dispersion was dispersed in a nanomizer (manufactured by Nanomizer K.K.) under an impact pressure of 1,000 kg/cm³, obtaining an organic acid silver dispersion. The thus obtained organic acid silver dispersion contained needle grains of organic acid silver having a mean minor diameter of 0.04 μm, a mean major diameter of 0.8 μm and a coefficient of variation of 30%.

Reducing agent dispersion

A slurry was obtained by adding 850 grams of water te 100 grams of 1,1-bis(2-hydroxy-3,5-dimethylphenyl)-3,5,5-trimethylhexane and 50 grams of hydroxypropyl cellulose and thoroughly mixing them. This slurry was introduced into a vessel together with 840 grams of zirconia beads having an average diameter of 0.5 mm. A dispersing machine (¼G Sand Grinder Mill by Imex K.K.) was operated for 5 hours for dispersion, obtaining a reducing agent dispersion.

Organic polyhalogenated compound dispersion

A slurry was obtained by adding 940 grams of water to 50 grams of tribromomethylphenylsulfone and 10 grams of hydroxypropyl methyl cellulose and thoroughly mixing them. This slurry was introduced into a vessel together with 840 grams of zirconia beads having an average diameter of 0.5 mm. A dispersing machine (¼G Sand Grinder Mill by Imex K.K.) was operated for 5 hours for dispersion, obtaining an organic polyhalogenated compound dispersion.

Image forming layer coating solution

An image forming layer coating solution was prepared by thoroughly mixing 100 grams of the organic acid silver dispersion, 20 grams of the reducing agent dispersion, 15 grams of the organic polyhalogenated compound dispersion, all prepared above, 40 grams of LACSTAR 33075 SBR latex (Tg 13° C., 49 wt %, by Dai-Nippon Ink & Chemicals K.K.), 20 grams of a 10 wt % aqueous solution of MP-203 polyvinyl alcohol (by Kurare K.K.), 20 grams of the silver halide emulsion prepared above, 8 ml of a 1 wt % methanol solution of hydrazine derivative (Compound 37a), and 100 grams of water.

This coating solution was applied so as to give a silver coverage of 1.5 g/m$^2$ and a polymer latex solid coverage of 5.7 g/m$^2$.

(7) Protective layer

Protective layer A (invention) coating solution

To 500 grams of a 40 wt % polymer latex (methyl methacrylate/styrene/2-ethylhexyl acrylate/2-hydroxyethyl methacrylate/methacrylic acid=59/9/26/5/1 copolymer, Tg 47° C.) was added 262 grams of $H_2O$. Further added thereto were 14 grams of benzyl alcohol, 2.5 grams of Compound-2, 3.6 grams of Serozoru 524 (Chukyo Yushi K.K.), 12 grams of Compound-3, 1 g of Compound-4, 2 grams of Compound-5, and 7.5 grams of Compound-6 as film forming aids and 3.4 grams of polymethyl methacrylate fine particles having a mean particle size of 3 $\mu$m as a matte agent. $H_2O$ was further added to a total weight of 1,000 grams, obtaining a protective layer coating solution having a viscosity of 5 cp at 25° C. and pH 3.4 at 25° C.

This coating solution was applied so as to give a polymer latex solid coverage of 2 g/m$^2$.

Compound-2

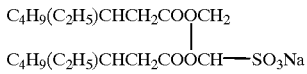

Compound-3

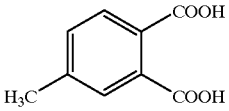

Compound-4

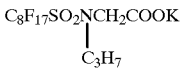

Compound-5

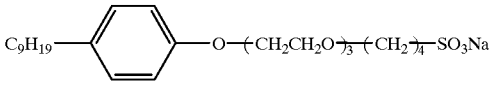

-continued

Compound-6

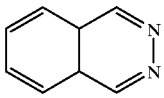

Protective layer B (comparison) coating solution

To 200 grams of alkali-treated gelatin powder ($Ca^{++}$ content 0.06 ppm, jelly strength 260 g) was added 1,800 grams of $H_2O$. This was heated at 50° C. for dissolution and then cooled to 40° C. As in the preparation of the polymer latex protective layer coating solution, Serozoru 524, Compound-2 to Compound-6, and the matte agent were added thereto. $H_2O$ was further added to a total weight of 3,000 grams, obtaining a protective layer coating solution having a viscosity of 15 cp at 25° C. and pH 4.0.

This coating solution was applied so as to give a gelatin coverage of 2 g/m$^2$.

By the following test, the thus obtained samples were examined for wrinkle after heat development and dimensional changes associated with heat development. The results are shown in Table 24.

It is noted that Tg was measured by differential scanning calorimetry (DSC). The respective samples had a Bekk smoothness of 1,500 seconds on the emulsion side and 350 seconds on the back side.

1) Test for wrinkle after heat development

Using the heat developing apparatus shown in FIG. 1, samples sized 60 cm×75 cm were heat developed under conditions including a developing temperature of 110° C., 115° C. or 120° C. and a developing time of 10 seconds, 20 seconds or 30 seconds in proper combination. The samples as heat developed were visually observed for the occurrence of wrinkle. The sample was rated "Sound" when it was free of wrinkles under all the sets of developing conditions, but rated "Wrinkled" when wrinkles occurred under any set of developing conditions.

It is noted that in the drum type heat developing apparatus of FIG. 1, the light distribution of the lamp was optimized so as to achieve a temperature precision within ±1° C. in an axial direction.

2) Test for dimensional changes associated with heat development

After light exposure over their entire surface, samples sized 5 cm×25 cm were perforated with two holes having a diameter of 8 mm at a spacing of 200 mm. The spacing between the two holes was precisely measured by means of a pin gauge with a precision of 1/1000 mm. The spacing at this time is X (unit mm). Next, using the heat developing apparatus of FIG. 1, the samples were heat developed at 120° C. for 30 seconds. After 10 minutes, the hole-to-hole spacing was measured again by means of the pin gauge. The spacing at this time is Y (unit mm). A percent dimensional change is calculated according to $$\text{Dimensional change}=[(Y-X)/200]\times 100\%.$$

The dimensional changes were determined in a machine direction (MD) and a transverse direction (TD).

TABLE 24

| Sample No. | No. of support with back/ subbing layer | Protective layer on image forming layer side (binder type) | Wrinkling | Dimensional change MD | Dimensional change TD |
|---|---|---|---|---|---|
| 1 (comparison) | 1 | B (gelatin) | Wrinkled | −0.165 | 0.750 |
| 2 | 1 | A (polymer latex) | Sound | −0.150 | 0.750 |
| 3 (comparison) | 2 | B (gelatin) | Wrinkled | −0.010 | 0.007 |
| 4 | 2 | A (polymer latex) | Sound | −0.008 | 0.015 |
| 5 (comparison) | 3 | B (gelatin) | Wrinkled | −0.015 | 0.010 |
| 6 | 3 | A (polymer latex) | Sound | −0.008 | 0.019 |
| 7 (comparison) | 4 | B (gelatin) | Wrinkled | −0.020 | 0.020 |
| 8 | 4 | A (polymer latex) | Sound | −0.010 | 0.025 |
| 9 (comparison) | 5 | B (gelatin) | Wrinkled | −0.034 | 0.029 |
| 10 | 5 | A (polymer latex) | Sound | −0.025 | 0.033 |
| 11 (comparison) | 6 | B (gelatin) | Wrinkled | −0.017 | 0.007 |
| 12 | 6 | A (polymer latex) | Sound | −0.005 | 0.014 |
| 13 (comparison) | 7 | B (gelatin) | Wrinkled | −0.014 | 0.002 |
| 14 | 7 | A (polymer latex) | Sound | −0.003 | 0.010 |
| 15 (comparison) | 8 | B (gelatin) | Wrinkled | −0.039 | 0.018 |
| 16 | 8 | A (polymer latex) | Sound | −0.030 | 0.024 |

As is evident from Table 24, the samples within the scope of the invention are not wrinkled or creased upon heat development. The supports which have been properly heat treated according to the invention experience a minimal dimensional change before and after heat development.

EXAMPLE 2

Samples were prepared by the same procedure as sample Nos. 2 and 14 in Example 1 except that Jurimer ET-410 and Chemipearl S-120 used as the polymer latex in conductive layer (3) and back side protective layer (4) in sample Nos. 2 and 14 in Example 1 were replaced by alkali-treated gelatin ($Ca^{++}$ content 30 ppm, jelly strength 230 g), and Denacol EX-614B as the crosslinking agent was replaced by 2,4-dichloro-6-hydroxy-S-triazine (2 wt % based on gelatin).

As in Example 1, these samples were examined for wrinkle after heat development and dimensional changes associated with heat development. The results are shown in Table 25.

TABLE 25

| Sample No. | Heat treatment on feed: Heat treatment Tension (kg/cm$^2$) | Heat treatment Temp. (° C.) | Post heat treatment Time (sec.) | Post heat treatment Temp. (° C.) | Binder in conductive layer/ protective layer | Wrinkling | Dimensional change (%) MD | Dimensional change (%) TD |
|---|---|---|---|---|---|---|---|---|
| 17 (comparison) | — | — | — | — | Gelatin | Wrinkled | −0.160 | 0.748 |
| 2 | — | — | — | — | Polymer latex | Sound | −0.150 | 0.750 |
| 18 (comparison) | 3 | 200 | 15 | 40 | Gelatin | Wrinkled | −0.010 | 0.008 |
| 14 | 3 | 200 | 15 | 40 | Polymer latex | Sound | −0.003 | 0.010 |

As is evident from Table 25, the samples within the scope of the invention are not wrinkled or creased upon heat development. The supports which have been properly heat treated according to the invention experience a minimal dimensional change before and after heat development.

EXAMPLE 3

Samples were prepared by the same procedure as sample No. 14 in Example 1 except that the polymer latex in the protective layer A on the image forming layer side was replaced by the same amount of each of the following polymer latexes. Note that Tg is as measured by DSC.

| | Trade name | Tg | Manufacturer |
|---|---|---|---|
| (a) | VONCORT R3370 | 25° C. | DIC |
| (b) | VONCORT 4280 | 15° C. | DIC |
| (c) | VONCORT 2830 | 38° C. | DIC |
| (d) | HYDRAN AP10 | 37° C. | DIC |
| (e) | HYDRAN AP-40 | 55° C. | DIC |
| (f) | Nipol Lx857x2 | 37° C. | Nippon Zeon |
| (g) | Nipol G567 | 17° C. | Nippon Zeon |
| (h) | LACSTAR 3307B | 13° C. | DIC |
| (i) | Aron D5071 | 36° C. | Toa Synthesis |
| (j) | VONDIC 1320NS | 53° C. | DIC |
| (k) | methyl methacrylate/styrene/2-ethylhexyl acrylate/2-hydroxyethyl methacrylate/acrylic acid=59/10/23/5/3 (wt %) copolymer 53° C. | | |

DIC: Dai-Nippon Ink & Chemicals K.K.

As in Example 1, these samples were examined for wrinkle after heat development and dimensional changes associated with heat development. No wrinkle occurred. After the heat development, the samples showed dimensional changes as small as 0.002 to 0.004% in MD and 0.009 to 0.011% in TD.

It was also found that the polymer latexes having a Tg of 25° C. or higher were preferable when the samples were examined for the adhesion to the heat drum (i.e., the ease of peeling of the sample from the heat drum at the end of heat development) and the strength of coating film (i.e., scratch strength).

EXAMPLE 4

Samples were prepared by the same procedure as sample o. 14 in Example 1 except that the polymer latex LACSTAR 307B in the image forming layer was replaced by the same mount of each of the SBR latexes shown in Table 26. Note hat sample No. 23 in Table 26 is identical with sample No. 14 in Example 1. In Table 26, Nipol is a trade name of SBR latexes by Nippon Zeon K.K., LACSTAR and LQ are trade names of SBR latexes by Dai-Nippon Ink & Chemicals K.K.; Tg was as measured by DSC; and the gel fraction was determined by applying a polymer latex, drying at a temperature of 70° C. to form a film sample, immersing the film sample in THF at 25° C. for 24 hours, quantitatively determining the content of insolubles, and calculating according to the equation.

Gel fraction (%)=(weight (g) of insolubles)/(weight (g) of polymer latex film)×100

Photographic test

After the samples prepared above were exposed to xenon flash light for an emission time of $10^{-6}$ sec through an interference filter having a peak at 780 nm and a step wedge, they were heat developed at 115° C. for 20 seconds by the same heat developing apparatus as in Example 1. The resulting images were measured for a maximum density (Dmax) and minimum density (Dmin) by means of a Macbeth densitometer. The results are shown in Table 26.

TABLE 26

| Sample No. | Polymer latex in image forming layer | Tg (° C.) | Gel fraction (wt %) | Dmin | Dmax |
|---|---|---|---|---|---|
| 19 | Nipol Lx110 | −52 | 89 | 0.50 | 3.9 |
| 20 | Nipol Lx435 | −19 | 53 | 0.15 | 3.7 |
| 21 | LACSTAR 7132C | 2 | 89 | 0.08 | 3.8 |
| 22 | Nipol Lx430 | 4 | 84 | 0.09 | 3.9 |
| 23(=14) | LACSTAR 3307B | 13 | 73 | 0.07 | 3.9 |
| 24 | Nipol Lx416 | 47 | 73 | 0.09 | 2.0 |
| 25 | LQ-618-1 | 40 | 32 | 0.09 | 3.9 |
| 26 | Nipol Lx2507 | 53 | 20 | 0.40 | 3.5 |

It is evident from Table 26 that when polymer latexes having a glass transition temperature of −20° C. to 40° C. and a gel fraction of 30% to 90% are used as the binder in the image forming layer, improved photographic properties including a high Dmax and a low Dmin are obtained.

Example 5

Samples were prepared by the same procedure as sample No. 14 in Example 1 except that the polymer latex LACSTAR 3307B in the image forming layer was replaced by the same amount of each of the following polymer latexes. Note that Tg is as measured by DSC.

| | Polymer latex | Tg |
|---|---|---|
| (m) | ethyl methacrylate homopolymer | −24° C. |
| (n) | methyl methacrylate homopolymer | 18° C. |
| (o) | cyclohexyl acrylate homopolymer | 32° C. |

-continued

| | Polymer latex | Tg |
|---|---|---|
| (p) | HYDRAN AP10 (Dai-Nippon Ink & Chemicals K.K.) | 37° C. |
| (q) | VONCORT 2210 (Dai-Nippon Ink & Chemicals K.K.) | 0° C. |
| (r) | styrene/butadiene/hydroxyethyl methacrylate /divinyl benzene = 67/30/2.5/0.5 (wt %) | 20° C. |

The samples were tested for photographic properties as in Example 4, confirming that images having a high Dmax and a low Dmin were obtained.

There have been described thermographic image-recording elements wherein polymer latexes are used as the binder in the image forming layer and the protective layer so that the elements are free from wrinkling upon heat development. Where properly heat-treated supports are used, the elements experience minimal dimensional changes before and after heat development.

Japanese Patent Application No. 261016/1997 is incorporated herein by reference.

Reasonable modifications and variations are possible from the foregoing disclosure without departing from either the spirit or scope of the present invention as defined by the claims.

What is claimed is:

1. A thermographic image-recording element comprising a support, an image-forming layer thereon containing at least (a) an organic silver salt, (b) a reducing agent, and (c) a photosensitive silver halide, at least one protective layer on the image-forming layer, and at least one back layer on an opposite side of the support to the image-forming layer, wherein a synthetic polymer latex is used as a binder in each of the image-forming layer, the protective layer and the back layer.

2. The thermographic image-recording element of claim 1 wherein the synthetic polymer latex used as the binder in the protective layer is selected from the group consisting of a acrylic latex, styrene latex, acryl/styrene latex, vinyl chloride latex, and vinylidene chloride latex.

3. The thermographic image-recording element of claim 1 wherein the binder in the protective layer has a glass transition temperature of 25° C. to 100° C.

4. The thermographic image-recording element of claim 1 wherein a styrene-butadiene latex is used as the binder in the image-forming layer.

5. The thermographic image-recording element of claim 1 wherein the binder in the image-forming layer has a glass transition temperature of −30° C. to 40° C.

6. The thermographic image-recording element of claim 1 wherein the binder in the image-forming layer has a gel fraction of 30% to 90% by weight.

7. The thermographic image-recording element of claim 1 herein the protective layer located remotest from the support contains microparticulates having a mean particle size of 1 μm to 10 μm.

8. The thermographic image-recording element of claim 1 wherein the support has a first side and a second side so that the first side is an image forming layer side and the second side is opposite the first side, and the image recording element further comprises:

undercoat layers adjacent to the first side and second side; and at least one back layer facing the second side, wherein at least one of the undercoat layers or back layers contains a metal oxide.

9. The thermographic image-recording element of claim 1 wherein there are at least first and second back layers so that the first back layer is outermost from the support, and the second back layer contains microparticulates having a mean particle size of 1 $\mu$m to 10 $\mu$m.

10. The thermographic image-recording element of claim 1 wherein the protective layer at its surface has a Bekk smoothness of up to 2,000 seconds.

11. The thermographic image-recording element of claim 1 wherein the support is a biaxially oriented polyester.

12. The thermographic image-recording element of claim 11 wherein the support has been treated so as to improve the adhesion thereof to the image-forming layer and/or the back layer and then heat treated at a temperature of 130° C. to 210° C.

13. The thermographic image-recording element of claim 12 wherein the heat-treated support has a heat shrinkage factor of −0.03% to 0.01% in a machine direction and 0% to 0.04% in a transverse direction when heated at 120° C. for 30 seconds.

14. The thermographic image-recording element of claim 1, wherein the polymer has a molecular weight of about 5,000 to 1,000,000.

15. The thermographic image-recording element of claim 1, wherein the binder contains up to 20% of a hydrophilic polymer selected from the group consisting of polyvinyl alcohol, methyl cellulose, hydroxypropyl cellulose, carboxymethyl cellulose, and hydroxypropyl methyl cellulose.

16. The thermographic image-recording element of claim 1, wherein a total amount of the binder in the protective layer is about 0.2 to 5.0 g/m$^2$.

17. The thermographic image-recording element of claim 1, wherein a total amount of the binder in the image forming layer is about 0.2 to 30 g/m$^2$.

18. The thermographic image-recording element of claim 1, wherein a total amount of the binder in the back layer is about 0.05 to 1.5 g/m$^2$.

19. The thermographic image-recording element of claim 8, the metal oxide containing layer has a surface resistivity of up to $10^{12}$ Ω.

* * * * *

UNITED STATES PATENT AND TRADEMARK OFFICE

CERTIFICATE OF CORRECTION

PATENT NO. : 6,132,950
DATED : October 17, 2000
INVENTOR(S) : Kunio Ishigaki et al.

It is certified that error appears in the above-identified patent and that said Letters Patent is hereby corrected as shown below:

Column 98,
Line 55 (claim 7), please change "herein" to -- wherein --.

Signed and Sealed this

Sixteenth Day of October, 2001

*Attest:*

Nicholas P. Godici

*Attesting Officer*

NICHOLAS P. GODICI
*Acting Director of the United States Patent and Trademark Office*